US005205960A

United States Patent [19]

Kristopeit et al.

[11] Patent Number: 5,205,960

[45] Date of Patent: Apr. 27, 1993

[54] METHOD OF MAKING CLEAR, STABLE PRESPOTTER LAUNDRY DETERGENT

[75] Inventors: Karen K. Kristopeit, Franksville; Calvin J. Verbrugge, Racine, both of Wis.

[73] Assignee: S. C. Johnson & Son, Inc., Racine, Wis.

[21] Appl. No.: 677,710

[22] Filed: Mar. 29, 1991

Related U.S. Application Data

[63] Continuation-in-part of Ser. No. 130,768, Dec. 9, 1987, abandoned.

[51] Int. Cl.[5] ..... C11D 3/37; C11D 1/66; C11D 3/075; C11D 3/20

[52] U.S. Cl. ..... 252/174.24; 252/174.21; 252/174.12; 252/135; 252/527; 252/528; 252/540; 252/559; 252/173; 252/DIG. 14; 252/DIG. 2

[58] Field of Search ..... 252/174.23, 174.24.174.21, 252/174.12, 135, 527, 528, 540, 559, 173, DIG. 14, DIG. 12, DIG. 2, DIG. 15

[56] References Cited

U.S. PATENT DOCUMENTS

| | | | |
|---|---|---|---|
| 3,691,107 | 9/1972 | Erdy et al. | 252/544 |
| 4,318,818 | 3/1982 | Letton et al. | 252/174.12 |
| 4,404,115 | 9/1983 | Tai | 252/135 |
| 4,432,881 | 2/1984 | Evani | 252/85 A |
| 4,559,159 | 12/1985 | Denzinger et al. | 252/174.24 |
| 4,871,823 | 10/1989 | Billman et al. | 526/272 |
| 5,004,557 | 2/1991 | Nagarajan et al. | 252/174.24 |
| 5,008,032 | 4/1991 | Diessel et al. | 252/174.24 |

FOREIGN PATENT DOCUMENTS

| | | |
|---|---|---|
| 0000224 | 1/1979 | European Pat. Off. . |
| 1596756 | 8/1978 | United Kingdom . |

*Primary Examiner*—Paul Lieberman
*Assistant Examiner*—Erin M. Higgins

[57] ABSTRACT

A method of making a heavy duty clear, single phase, solvated built aqueous liquid detergent composition. The composition consists essentially of at least one nonionic surfactant, at least one builder, an effective amount of a water soluble polymeric anionic hydrotrope to render the composition clear, stable and single phase which hydrotrope is a specific polymer of maleic anhydride and at least one alpha olefin, and water wherein the composition has a pH in the range of from 6 to 9. The novel hydrotrope used is a hydrolyzed (a) copolymer of maleic anhydride and a $C_6$ to $C_{24}$ alpha olefin or (b) ter- or higher polymer of maleic anhydride with two or more $C_6$ to $C_{30+}$ alpha olefins as long as one of the alpha olefins is a $C_2$ to $C_{18}$ alpha olefin and the ratio of alpha olefins present are such that the average alpha olefin carbon chain length in the ter- or higher polymer is greater than about 6 and less than about 18. Additionally, methods of making stable, one phase compositions of this type which further include a cationic fabric softening agent which are clear, stable and single phase.

21 Claims, No Drawings

METHOD OF MAKING CLEAR, STABLE PRESPOTTER LAUNDRY DETERGENT

This is a continuation-in-part of copending U.S. Ser. No. 07/130,768 filed on Dec. 9, 1987, now abandoned.

TECHNICAL FIELD

This invention relates to a clear stable single phase built liquid detergent composition which is nonionic in nature and contains a water soluble polymeric anionic hydrotrope which is a hydrolyzed alpha olefin maleic anhydride polymer. This polymer has at least one alpha olefin having a carbon content in the range of $C_6$ to about $C_{24}$ for copolymers and alpha olefins of $C_2$ to $C_{30+}$ carbon content for polymers containing two or more alpha olefins, more preferably from $C_6$ to $C_{18}$, and most preferably, $C_6$ to $C_{10}$ copolymers. The hydrolyzed alpha olefin maleic anhydride polymer acts as a coupling agent or hydrotrope between the separate phases normally inherent in built nonionic liquid detergents to provide the clear homogeneous detergent composition of the present invention. Moreover, it has been unexpectedly discovered that the use of this hydrotrope significantly increases the cleaning power and prespotting capabilities of the detergent composition such that the detergent, when used alone, performs at least equal to a liquid laundry detergent for detergency and better than a normal liquid laundry detergent as a prespotter. Moreover, it has been unexpectedly observed that this detergent composition, in spite of the use of the anionic alpha olefin maleic anhydride polymers, is stable to inclusion of cationic quaternary ammonium fabric softeners/disinfectants which normally would separate out of a detergent composition.

BACKGROUND ART

Normal powder detergents are a mixture of surfactants and inorganic builders in a ratio of about 1:1 to 1:2. When these components are concentrated into a liquid detergent form, there is a multiphase separation, particularly when nonionic surfactants are present since nonionic surfactants are not very tolerant of ionic inorganic builders.

Historically, liquid detergents have recognized and struggled with this incompatibility. In the past, manufacturers formulated built liquid detergents that separated into two phases and simply instructed the consumer to shake the product well before using it. Currently, consumers are less likely to accept liquid detergent products which require shaking before use even though such products have good cleaning performance when properly shaken to combine the separate phases together. The result has been that current commercial liquid laundry detergents are almost all surfactants with very little or no inorganic builders present. The inorganic builders are desirable because they are the lowest cost cleaning components in detergents.

Recent developments have partially solved this problem by using more expensive organic, polycarboxylate builders and by suspending inorganic builders in the liquid detergent system. Whereas these systems have been successful as a detergent, they have not provided good prespotter properties. One problem with the addition of a polymer to an aqueous liquid detergent composition, particularly to a built liquid detergent composition, is that the polymer sometimes tends to undesirably render the composition unstable and to cause phase separation.

Good detergency and good prespotting properties have also historically been incompatible in a single liquid. The best cleaning detergents have been highly built, high alkaline systems. However, in a liquid detergent, high alkalinity will fix certain stains such as coffee, tea and red wine. Highly alkaline liquids can also cause skin irritations.

This invention discloses a clear homogeneous built liquid system containing nonionic surfactants which is neutral to slightly alkaline and excellent for prespotter use.

European Patent Application EP 0 000 224 A1 to Smith et al. teaches liquid and solid detergents for improved greasy soil removal. The improved greasy soil removal properties are the result of the presence of an essential ingredient which is a 3-component active system comprising anionic surfactants, alkoxylated nonionic surfactants and water soluble cationic surfactants. It is a further example of the use of conventional hydrotrope agents in liquid detergent formulations since it teaches that conventional hydrotropes such as sodium benzoate or sodium salts of toluene, xylene or cumene sulphonates can be included for insuring phase stability of the liquid compositions. Smith et al. teach the use of water soluble polycarboxylates as detergency builders.

Furthermore, Smith et al. teach that 0.1% to about 3% of a further optional, but preferred, component can be included which is a polymeric material of molecular weight 2,000 to 2,000,000. They do not suggest using such materials as hydrotropes for built liquid detergent compositions of the type used in the present invention. That polymeric material includes a wide variety of possible polymers made by the polymerization of maleic acid or maleic anhydride with a polymerizable comonomer which includes alkyl esters of acrylic and methacrylic acid, styrene, N-vinyl pyrrolidone or monoolefins of the formula (iii) $H(R_4)C{=}C(R_5)H$ where each of $R_4$ and $R_5$ is H or an alkyl group such that $R_4$ and $R_5$ together have 0 to 10 carbon atoms. Examples 7 and 8 of Smith et al. teach the use of GANTREZ AN119 which is a maleic anhydride/methyl vinylether copolymer. We have found that maleic anhydride/methyl vinylether copolymers do not act as hydrotropes in the present invention nor do copolymers of maleic anhydride and 1-butene. On page 30, lines 22–35 of Smith et al., the applicants teach that in place of GANTREZ AN119 in the working examples, various other maleic anhydride copolymers can be used such as an ethylene-maleic acid copolymer of molecular weight ("MW") 4,000, a propylene-maleic acid copolymer of MW 30,000, a 1-hexene-maleic acid copolymer of MW 25,000 or MW 30,000, a vinyl pyrrolidone-maleic acid copolymer of MW 26,000, among others. We have found that although 1-hexene/maleic anhydride copolymers are useful as hydrotropes in the present invention, that those copolymers containing alpha olefins with less than 6 carbon atoms as well as those made with methyl vinylether are not useful as hydrotropes. The built liquid detergent compositions of Smith et al. did not give clear, stable and single phase compositions. Thus Smith et al. does not suggest the method of the present invention and in fact specifically teaches that conventional hydrotropes should be used for insuring phase stability.

British Patent Specification No. 1 596 756 is assigned to Procter & Gamble Limited, a subsidiary of Procter &

Gamble Company to which the Smith et al. patent application is assigned. The disclosure of the '756 Patent is similar to and contains a broader teaching of maleic anhydride/acid copolymers than does the Smith et al. Patent. The '756 Patent teaches solid and liquid detergent compositions which require three components: an organic detergent, a phosphate builder based on orthophosphate, pyrophosphate and tripolyphosphate salts; and a builder auxiliary which is a mixture of (i) up to 4% of a polyphosphonic acid or salt thereof and (ii) up to 4% of a homo- or copolymeric polycarboxylic acid or salt thereof. The critical features of the ingredients used are described on page 1, lines 6–29 and on page 2, lines 44–51: small amounts of a mixture of polyacids improve the performance in whiteness retention (i.e., the antiredeposition properties) and ash deposition (i.e., precipitation of insoluble phosphate salts on clothing) of detergents containing the phosphate builders noted above.

Thus, the '756 Patent requires phosphate builders which have fallen into environmental disfavor for use in detergents as well as two builder auxiliaries, one of which can be a copolymer of maleic anhydride with other polymerizable monomers. Examples 24–26 of the '756 Patent employ 1%, 1%, and 0.5%, respectively, of GANTREZ AN139 which is a copolymer of maleic anhydride and methyl vinylether. Among the variety of monomers which are taught are those of the formula $R_4R_6C{=}CR_5R_7$ where each of $R_4$ to $R_7$ is —H or and alkyl group such that $R_4$ to $R_7$ together have from 1 to 20 carbon atoms, $R_4$ to $R_7$ each optionally being hydroxy substituted. However these polymers are used in conjunction with a polyphosphonate for a purpose different from that of the method of the present invention. A further point of difference is that on page 10, the '756 Patent teaches that when the olefins of the previously described formula are used, the copolymers are preferably of high molecular weight and are preferably based on ethylene which is not operative in the method of the present invention. This teaching is present although page 16 of the '756 Patent contains the same language concerning substitution of other maleic acid copolymers such as those employing 1-hexene as is found on page 30 of Smith et al.

Therefore neither Smith et al. nor the '756 Patent suggest the method of the present invention which requires certain specific hydrolyzed polymers of maleic anhydride and alpha olefins to serve as hydrotropes in certain built liquid detergent compositions which contain nonionic surfactants.

Detergent compositions containing polymers as builders are old and well known in the art. A number of these patents can be seen by reviewing the literature.

Erdy et al., in U.S. Pat. No. 3,691,107, disclose a novel detergent composition comprising a mixture of one or more surfactants with a unique builder which comprises a cross-linked, water-insoluble polymer of at least one $C_4$–$C_{10}$ olefin and at least one polycarboxyl vinyl monomer. The cross-linked water insoluble polymer is a water-swellable gel forming material. This patent is of particular interest to the present art in examining Example 1, Table 1 as contained in column 11, lines 7–35. Specifically, alpha olefin maleic anhydride polymers disclosed, some of which are contemplated for use in the present invention, are disclosed as old and well known in the art. However, a reading of the Example indicates that they are being used in the Erdy patent Example as part of a powder detergent composition. No hydrotrope properties are described as being inherent in the alpha olefins of the Erdy composition and they further differ from the hydrotropes used in the present invention in that they are cross-linked with diamines and triamines and with diols and triols. The Erdy polymers are then hydrolyzed to make water insoluble swellable gels. All the examples are for powdered detergents and although they do mention an aqueous dispersion of the detergent composition, they are cloudy, two-phased liquids which do not possess the cleaning and anti-redeposition properties of the present invention. Moreover, the levels at which the alpha olefin maleic anhydride polymers are used at are a level of 40% by weight of the composition. It would appear that the use of the polymer is as a builder substitute, which is known in the art, and not as a hydrotrope or anti-redeposition agent which unexpectedly gives superior cleaning and prespotting capabilities to the detergent.

Moreover, it has been unexpectedly found that the hydrolyzed alpha olefin maleic anhydride copolymers useful in the present invention are in a range of $C_6$ to about $C_{24}$ and specific polymers containing at least two different alpha olefins of $C_2$ to $C_{30+}$ carbon content, and most preferably, $C_6$ to $C_{10}$ copolymers, are able to bring together as a coupling agent the nonionic surfactants and the builders in such a manner as to present a clear, stable, single-phase liquid detergent composition which has the aforementioned prespotting and increased detergency. The prior art fails to teach the method of using the specific hydrolyzed maleic anhydride polymers of the present invention as hydrotropes to produce such clear and stable nonionic surfactant-containing built liquid detergent compositions.

Rosnati, U.S. Pat. No. 3,208,949 discloses ethylene maleic anhydrides and polyvinyl methacrylate maleic anhydride interpolymers for use in a heavy duty or built liquid detergent system. The Rosnati patent discloses the use of a caprylic acid salt to function as a binary system to stabilize a built detergent into a substantially homogeneous pourable liquid detergent. The present invention does not contemplate the use of caprylic acid salts or any other type of binary agent for stability of the phases. Rather, the hydrolyzed alpha olefin maleic anhydride polymers by themselves are the stabilizing cleaning agents with the anti-redeposition properties for which Rosnati uses caprylic acid salts. Accordingly, the present invention differs from Rosnati.

Tsukuni et al., U.S. Pat. No. 3,830,745 depicts a detergent composition which includes anionic or nonionic surface active agents, and as a builder, a novel water soluble salt of a copolymer of cyclopentene or its derivatives with maleic anhydrides. These cyclopentene maleic anhydride copolymers are hydrolyzed to form an alkali metal carboxylate salt to function as novel builders. The molecular weight of the copolymer is stated as 350 to 2000. It must be understood that this is a powder system and does not encompass the liquid detergent system of the present invention. Tsukuni does not contemplate a clear, stable, single phase built liquid detergent in which an alpha olefin maleic anhydride copolymer of a carbon range of $C_6$ to about $C_{24}$ and polymers containing at least two different alpha olefins of $C_2$ to $C_{30+}$ and most preferably, $C_6$ to $C_{10}$ copolymers, functions as a hydrotrope to bring two normally incompatible phases of a liquid detergent together into a clear homogeneous solution. Moreover, since only cyclopentene maleic anhydride copolymers are utilized, it is obvious that the hydrotropic anti-redeposition properties inherent in the hydrolyzed alpha olefin maleic anhydride polymer of the present invention would not be apparent because the families of cyclopentene maleic anhydride copolymers and the alpha olefin maleic anhydride polymers of the present invention are different. Accordingly, the present invention differs from and is an improvement over Tsukuni et al.

Cooney, U.S. Pat. No. 3,852,213 discloses chelating compositions comprising 90 to 70% of polyvinyl methacrylate maleic anhydride copolymer and 3 to 30% borax, detergent dyeing, scouring and similar compositions containing the ingredients and a process for chelating varies Group II and Group III metal ions. The polyvinyl methacrylate maleic anhydride copolymer does not contemplate the hydrolyzed alpha olefin maleic anhydride polymers useful in the present invention. Accordingly, the present invention differs from Cooney.

Grifo et al., U.S. Pat. No. 3,328,309 depicts a liquid detergent composition having a surface active detergent ingredient in a liquid medium. The detergent may be any commonly used surfactants of the nonionic and anionic types and mixtures thereof. The Grifo et al. disclosure is important from the aspect that polymeric anhydrides having ethoxylated esters and anhydrides are similar but not the same as the hydrolyzed alpha olefin maleic anhydrides useful in the present invention. Indeed, the closest example between the alpha olefins of the present invention and those of the Grifo disclosure are propylene maleic anhydride copolymers.

The copolymers of Grifo et al. are all partial esters made by heating the anhydrides with ethoxylated or hydroxy containing surfactants to make partial esters. The present invention does not utilize such anhydride compositions and so differs from Grifo et al.

Renold, U.S. Pat. No. 3,509,059 depicts a stable, heavy duty liquid detergent composition which contains high electrolyte content as a builder which is produced in a stabilized form by polymerizing to a polymer a monomer in the presence of the detergent material. The polymer acts as a stabilizer for the compositions. The Renold composition differs from the present invention in that Renold is essentially a polymerization of an alpha, beta-unsaturated carboxylic acid to a surfactant. In other words, this is a polymer which is grafted onto a surfactant. The acid has to be converted to salt first in order to have a functioning system. Thus, it can be seen that this is not a polymer such as is used in the present invention but a grafted polymer. It follows that the stabilizing agent of Renold is chemically very different from the hydrotrope or stabilizing agent of the present invention. Accordingly, the present invention differs from Renold.

Tuvell, U.S. Pat. No. 3,235,505 teaches a liquid detergent emulsion with excellent stability against phase separation even though they are built detergent compositions. The excellent emulsion stability is said to be due to the presence of maleic anhydride type polymers wherein the comonomer is an olefinically unsaturated compound having less than 5 carbon atoms such as ethylene, propylene, isobutylene, vinyl methyl ether and the like. The maleic anhydride polymers used in the Tuvell emulsions can further be cross-linked with a diamine or a diolefinic compound. The Tuvell compositions differ from the present invention in that emulsions rather than solvated compositions are to be made. Tuvell also describes the final liquid detergent product obtained by his process as being very fluid and very white in color (see Example I) while the compositions of the present invention are required to be clear which are not taught in the Tuvell Patent.

Smith et al., U.S. Pat. No. 4,525,291 teaches built liquid detergent compositions which are single phase, clear and contain hydrogen peroxide along with stabilizers for that ingredient. However, it does not suggest the use of hydrolyzed polymers of maleic anhydride with certain alpha olefins as hydrotropes in such compositions.

SUMMARY OF THE INVENTION

The present invention is a method of making a clear, stable, solvated, single phase, built liquid laundry detergent utilizing an effective amount of a hydrolyzed alpha olefin maleic anhydride copolymer having a carbon range of $C_6$ to about $C_{24}$ and polymers containing at least two different alpha olefins of $C_2$ to $C_{30+}$, and more preferably from $C_6$ to $C_{18}$, and most preferably, $C_6$ to $C_{10}$ copolymers. The liquid laundry detergent is a heavy duty or built liquid detergent which is basically nonionic in nature and yet, is able to utilize borates, citrates, the nonphosphorus inorganic builders, the phosphates, the salts of nitrilotriacetic acid, salts of ethylenediamine tetraacetic acid, the nonphosphorus organic builders, and mixtures thereof as the main builders by the use of the hydrolyzed alpha olefin maleic anhydride polymers. Effective amounts, typically between about 1 to 10% by weight of the total built liquid detergent composition, of the hydrolyzed alpha olefin maleic anhydride polymers function as a hydrotrope to bring two different phases of a normally two phase system into a clear single phase liquid detergent which has remarkable cleaning and prespotting properties when compared to the prior art liquid detergents and powdered detergents.

Liquid detergents as a rule contain no builders or much lower concentrations of builders than powdered detergents. These builders, which are common in the art, are normally ionic, and by raising the concentration of ionics in solution, the nonionic surfactants of liquid detergents tend to separate or phase out. In order to make up for the loss of detergency for lack of builders, liquid detergents must use higher surfactant levels.

It has been discovered in the present invention that by using certain hydrolyzed water soluble polymeric anionic alpha olefin maleic anhydride polymers, the polymer acts as a hydrotrope to bring the builders in phase with the nonionic surfactants in an aqueous medium which forms a clear and stable single phase liquid detergent which is resistant to phase separation.

Moreover, the hydrolyzed alpha olefin maleic anhydride polymers useful in the present invention have surprisingly been found to act as an excellent anti-redeposition agent as well as an additional builder which aids in the cleaning power of the aqueous detergent. Accordingly, detergents formed according to the present invention have excellent prespotting and cleaning properties when compared with other liquid detergents as known in the art.

Further, it is another unexpected result of the use of the hydrolyzed alpha olefin maleic anhydride polymers that this built, single phase solvated liquid detergent is compatible with cationic quaternary ammonium fabric softeners which would normally separate out of solution in the presence of anionic detergents. Stable, one phase compositions which range from clear to translucent to opaque compositions containing cationic fabric softeners can be made and, in a more preferred embodiment, such compositions are clear in appearance. Accordingly, the use of the hydrolyzed alpha olefin maleic anhydride polymers function as hydrotropes to bring the nonionic surfactants and builder together in a solvated stable single phase liquid detergent and also allow the use of quaternary ammonium fabric softeners which are cationic in nature and would ordinarily separate out of a normal built liquid detergent.

DETAILED DESCRIPTION OF THE PREFERRED EMBODIMENT

The present invention is concerned with a clear, stable, solvated, single phase built liquid detergent composition which is able to use surprisingly large amounts of ionic builders. This is achieved by the use of an effective amount of a hydrolyzed, water soluble alpha olefin maleic anhydride polymer to produce a clear, stable and single phase aqueous detergent composition containing nonionic surfactants. Aqueous detergent compositions based on anionic surfactants which are free of nonionic surfactants tend to be much easier to produce in a clear and phase stable state since the surfactants and the builders are more compatible due to their ionic nature. Generally, from about 1 to 10% by weight of the total aqueous built liquid detergent composition is composed of the alpha olefin maleic anhydride polymer hydrotrope. The alpha olefin polymers useful as a hydrotrope in this invention can be made by the bulk process disclosed by U.S. Pat. No. 4,358,573 and the solution process of U.S. Pat. No. 4,522,992 incorporated herein by reference.

For the purposes of the present invention, the term "clear" is intended to mean that the solution formed is substantially transparent to visible light although a slight amount of haze may be present as long as one can see through the composition. The term "solvated" is intended to mean that the composition is substantially in the form of an aqueous solution or extremely fine dispersion as opposed to an emulsion of two different phases which results in light scattering and thus, optically translucent or opaque compositions. The term "single phase" is intended to mean that the compositions are clear and do not separate into two phases at room temperature and do not separate into two phases after being stored at 110° F. for 24 hours. This is one advantage of the present invention over other compositions of the prior art such as those stabilized by sodium xylene sulfonate which tends to be sensitive to temperature changes in its effectiveness as a hydrotrope and can separate into two phases upon exposure to heat.

The term "consisting essentially of" used in reference to the aqueous compositions is intended to exclude components such as waxes, hydrophobic silicone materials and other components which will render otherwise clear, stable and single phase aqueous compositions cloudy or unstable. The hydrolyzed alpha olefin maleic anhydride polymers useful in the present invention act as a coupling agent between nonionic surfactants and ionic builders to assist in producing clear, stable and single phase compositions, particularly those which retain such clarity and phase stability upon aging and exposure to heat, which would otherwise be cloudy or separate into two phases. The term "consisting essentially of" is also intended to mean that other conventional hydrotropes used to obtain clarity and phase stability in built liquid detergents are not necessary in the method of the present invention.

The alpha olefin maleic anhydride polymers useful in the present invention are polymers of maleic anhydride and at least one 1-alkene which are copolymers of maleic anhydride with an alpha olefin having about 6–24 carbon atoms and terpolymers or higher polymers with at least two different alpha olefins having from 2–30+ carbon atoms. Preferably, the polymers are comprised of from about 49 to 95 mole percent of maleic anhydride and from about 5 to 51 mole percent of alpha olefin. These polymers are partially disclosed in U.S. Pat. No. 4,358,573 (bulk processing) and U.S. Pat. No. 4,522,992 (solution processing) which patents are expressly incorporated by reference for their disclosure of suitable alpha olefin maleic anhydride polymers as well as in U.S. Pat. No. 4,871,823 entitled "1-Alkene/Excess Maleic Anhydride Polymers" issued on Oct. 3, 1989 in the names of Fred L. Billman, Lih-Bin Shih and Calvin J. Verbrugge and assigned to the same assignee as is the present invention which is likewise incorporated herein by reference.

The anhydride included in the alpha olefin maleic anhydride polymers is most preferably maleic anhydride. However, other maleic anhydrides can be utilized in this formation of the polymers such as methylmaleic anhydride, dimethylmaleic anhydride, fluoromaleic anhydride, methylethyl maleic anhydride and the like. Accordingly, as employed herein the term "maleic anhydride" includes such anhydrides in whole or in part. It is preferred that the anhydride be substantially free of acid and the like before polymerization.

The alpha olefins generally suitable in the formation of the polymers described herein have from 2 to 30+ carbon atoms and include the following: ethylene; propylene; 1-butene; 1-pentene; 1-hexene; 1-heptene; 1-octene; 1-nonene; 1-decene; 1-dodecene; 1-tetradecene; 1-hexadecene; 1-heptadecene; 1-octadecene; 2-methyl-1-butene; 3,3-dimethyl-1-pentene; 2-methyl-1-heptene; 4,4-dimethyl-1-heptene; 3,3-dimethyl-1-hexene; 4-methyl-1-pentene; 1-eicosene; 1-docosene; 1-tetracosene; 1-hexacosene; 1-octacosene; 1-triacontene; 1-tetracontene; 1-octatriacontene; 1-tetracontene; 1-octatetracontene; 1-pentacontene; 1-hexacontene; and mixtures thereof. The term "30+" or "$C_{30+}$" is used herein in its commonly accepted usage wherein a "$C_{30+}$" 1-alkene mixture is a mixture of high boiling 1-alkenes with carbon content between about 30 and 60 carbon atoms per molecule.

Mixtures of the above materials can be utilized. It is preferred to utilize straight chain 1-alkenes having from 6 to 18 carbon atoms, and accordingly, 1-hexene, 1-heptene, 1-octene, 1-nonene, 1-decene, 1-dodecene, 1-tetradecene, 1-hexadecene, 1-heptadecene, 1-octadecene, and mixtures thereof are preferred. These materials should be substantially free of diolefin as an impurity which causes gel formation and cross-linking. However, small amounts, i.e., less than 2 percent, can be present without causing undue gel formation and cross-linking in the resulting polymers. Also as noted above, either single materials, i.e., 1-hexene, 1-decene, etc., can be used, or mixtures of these materials may be utilized.

As is well known in the art, polymers containing equimolar ratios of alpha olefin maleic anhydride are essentially alternating polymers with maleic anhydride alternating between random comonomers. Accordingly, the alpha olefin maleic anhydride polymers may contain from about 49 to 95 mole percent of maleic anhydride and more preferably, from 49 to 70 mole percent of maleic anhydride. Under some conditions such as is described in the Billman et al. Patent noted above, it is possible to include an excess of maleic anhydride relative to the comonomer in these polymers. The amount of alpha olefin will correspondingly vary from about 51 down to about 5 mole percent. The optimum alpha olefin maleic anhydride polymers include about 50 mole % maleic anhydride and about 50 mole % alpha olefin, but this is dependent upon the alpha olefin selected. This is generally true for $C_{18}$ and higher carbon content alpha olefins while for polymers containing $C_6$ to $C_4$ alpha olefins, it is believed that greater than an equimolar amount of maleic anhydride up to about 60 mole percent is better.

Generally, it has been found that copolymers of maleic anhydride and a single alpha olefin having no less than 6 and no more than 24 carbon atoms are needed to obtain clear, single phase compositions, and more preferably, between 6 and 18 carbon atom alpha olefins Maleic anhydride polymers containing higher alpha olefins (i.e., more than 24 carbons per molecule) can be used in the compositions of the present invention in the form of ter- or higher polymers which also contain at least one $C_2$ to $C_{18}$ alpha olefin. Preferably, the ratio of $C_2$-$C_{18}$:$C_{18+}$ alpha olefins is such that the average alpha olefin carbon chain length in the polymer is greater than about 6 and less than about 18 to obtain clear, single phase solvated compositions.

For the best combination of anti-redeposition characteristics, detergency and oily stain removal, copolymers of maleic anhydride with a $C_6$ alpha olefin (i.e., 1-hexene) at about a 50:50 molar ratio are preferred. Alternatively, a copolymer of maleic anhydride with a $C_{10}$ alpha olefin (i.e., 1-decene) at about a 60:40 molar ratio of maleic anhydride to alpha olefin can be used with comparable results. The latter can be used as the hydrotrope in the compositions of the present invention for economic reasons since the $C_6$ alpha olefin polymers are more difficult to process.

The alpha olefin maleic anhydride polymers may be prepared by any of a number of conventional polymerization processes including polymerization processes as set forth in U.S. Reissue Pat. No. Re. 28,475, U.S. Pat. Nos. 3,553,177, 3,560,455, 3,560,456, 3,560,457, 3,488,311, 4,522,992 and 4,358,573. Another method by which such polymers can be prepared is the preferred method of making the polymers described in the Billman et al. Patent noted above. That method is described in U.S. Pat. No. 4,859,752 issued on Aug. 22, 1989 in the names of Thomas P. Bosanec, Kenneth R. Lukow and Calvin J. Verbrugge entitled "1-Alkene/Excess Maleic Anhydride Polymer Manufacture" and assigned to the same assignee as is the present invention.

The polymers useful in the present invention are generally low molecular weight materials having a number average molecular weight within the range of from about 500 to 50,000.

Nonionic surfactants are usually made by the condensation of an alkylene oxide (normally ethylene or propylene oxide) with an organic hydrophobic compound which is usually aliphatic or alkyl aromatic in nature. The degree of hydrophilic/hydrophobic balance of these nonionic surfactants is adjusted by shorter or longer chain lengths of the polyoxyalkylene constituent. The following are examples of suitable nonionic surfactants: polyethylene condensates of alkylphenols having an alkyl group containing from about $C_6$ to $C_{12}$ are useful. The ethylene oxide is present in an amount of about 5 to 25 moles of ethylene oxide per mole of alkylphenol. Commercial examples of these surfactants are Igepal CO-610 marketed by GAF Corporation, Surfonic N95 marketed by Texaco and TRITON X-100 sold by Rohm and Haas Company. Other surfactants useful are the condensation products of long chain fatty aliphatic alcohols having a carbon content of about $C_8$ to $C_{22}$ when ethoxylated with about 1 to 25 moles of ethylene oxide. Commercial examples of these surfactants are TERGITOL 15-S-9 from Union Carbide Corporation and NEODOL 25-3, 25-7 and 25-9 marketed by Shell Chemical Company.

Condensation products of ethylene oxide with hydrophobic bases formed by the condensation of polypropylene oxide with polypropylene glycols are also useful as nonionic surfactants. The hydrophobic base which is reacted with polypropylene oxide and polypropylene glycol should have a molecular weight of about 1500 to 1800. Examples of these polypropylene condensates are the PLURONIC surfactants from BASF Wyandotte Corporation. Condensation products of ethylene oxide with a reaction product of propylene oxide and ethylene diamine are also useful. The hydrophobic base of propylene and ethylene oxide usually has a molecular weight from 2500 to about 3000. The final surfactant has a molecular weight of from about 5,000 to 11,000. Commercial examples of these condensates are the compounds sold by BASF Wyandotte Corporation under the trademark TETRONIC.

Other examples are the semi-polar nonionic water soluble amine oxide surfactants having the formula:

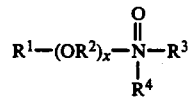

wherein $R^1$ is an alkyl, hydroxyl, or alkylphenol group having a carbon content of about $C_8$ to $C_{22}$, $R^2$ is an alkylene or hydroxy alkylene group having a carbon content of about $C_2$ to $C_3$, x is a number of from 0 to 3 and preferably 2, and $R^3$ and $R^4$ can be an alkyl or hydroxyalkyl group having a carbon content of about $C_1$ to $C_3$ or a polyethylene oxide group containing from about 1 to 3 ethylene oxide groups. APG 23-3 from A. E. Staley Manufacturing Company is an example of an ethoxylated polysaccharide.

Examples of commercial amine oxide surfactants are Ammonyx CDO or Ammonyx LO from Onyx Chemical Company. Other examples are tallow dimethyl amine oxide and coco alkoxyethyl dihydroxyethyl amine oxide.

Other useful condensation products include alkyl polysaccharides having the formula:

$$R^5\text{-}O(C_wH_{2w}O)_z(\text{Glycosyl})_q$$

wherein $R^5$ is an alkyl, alkylphenol, hydroxyalkyl or hydroxyalkylphenol group, said alkyl-containing groups having a carbon content of from about $C_{10}$ to $C_{18}$, w is a number from about 2 to 3, z is a number from about 0 to 10, and q is a number of from about 1 to 3.

Fatty acid amines are also useful as nonionic surfactants in this invention. The fatty acid amines are those having the formula:

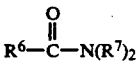

wherein $R^6$ is an alkyl group having a carbon content of about $C_7$ to $C_{21}$, $R^7$ is hydrogen, a $C_1$ to $C_4$ alkyl group, a $C_1$ to $C_4$ hydroxyalkyl group and $—(C_2H_4O)_pH$ where p varies from about 1 to 3, and mixtures of these surfactants. MAZAMIDE® C-2, PEG-3 cocomonoethanol amide, from Mazer Chemicals Inc. is an example of a fatty acid amide nonionic surfactant.

More specifically, the surfactants which are especially useful in the present invention are the NEODOL surfactants available from Shell Chemical Company and identified as $C_9$ to $C_{15}$ linear primary alcohol ethoxylates. Other suitable surfactants include the TERGITOL surfactants available from Union Carbide Corporation and identified as polyethylene glycol ethers of secondary alcohols, polyethylene glycol ethers of primary alcohols, mixed polypropylene glycols of linear alcohols, nonylphenol polyethylene glycol ethers, trimethyl nonyl polyalkylene glycol ethers, and polyalkylene glycol ethers.

Other nonionic surfactants which are especially useful in the present invention are ethoxylated nonylphenols and the ethoxylated octylphenols. Commercial examples of these chemicals are Surfonic N95 from Texaco, TRITON X100 from Rohm and Haas Company and Igepal CA620 from GAF Corporation. The ethoxylated secondary linear alcohols such as TERGITOL 15-S-9 from Union Carbide Corporation are also especially useful.

Ethoxylated nonylphenol surfactants result in the best oily stain removal. The $C_9$ to $C_{15}$ linear primary alcohol ethoxylates of the NEODOL surfactant type have the advantage of being easier to disperse in detergent compositions. The nonionic surfactants are present in a range of from 5 to 25 weight percent and for optimum detergency, at least 10% to 25% by weight nonionic surfactant is present in the compositions of the present invention.

At least one builder is present in an amount of from about 2 to 25% by weight of the composition and for better stain removal and water hardness control, from about 5% to 10% by weight of the composition. Detergency can be further improved by increasing the amount of builder present up to 25% by weight of the composition. Presumably, all effective ionic builders known in the art will prove effective in this system. However, those of special interest are the borates, citrates, the nonphosphorus inorganic builders, the phosphates, nitrilotriacetic acid or its salts, ethylenediamine tetraacetic acid or its salts, the nonphosphorus organic builders, and mixtures thereof. The presently preferred builder is selected from a salt of nitrilotriacetic acid such as trisodium nitrilotriacetate. Borates are useful to buffer the system and improve the whiteness and stain removal characteristics of the composition.

The borates may be selected from the group consisting of sodium tetraborate, disodium octoborate tetrahydrate, sodium metaborate, the analogous potassium salts and mixtures thereof. Although more can be used, generally, no more than about 10% by weight borates are present in the compositions of the present invention.

The phosphates, although currently in disfavor with ecologists, may also be useful in this invention. The phosphates may be selected from the group consisting of sodium tripolyphosphate, tetrapyropolyphosphate, tetrasodium pyrophosphate, disodium pyrophosphate, sodium metaphosphate, sodium hexametaphosphate, the analogous potassium salts of these compounds, and mixtures thereof.

An example of a citrate builder is sodium citrate.

The nonphosphorus inorganic builders are carbonates and particularly those selected from the group consisting of sodium carbonate, potassium carbonate, sodium bicarbonate, sodium sesquicarbonate, and mixtures thereof.

The nonphosphorus organic builders useful in the present invention are those which are selected from the group consisting of alkali metal, ammonium, and $C_1$ to $C_4$ alkylammonium salts of polyacetates, carboxylates, polycarboxylates, and polyhydroxy sulfonates as well as mixtures thereof.

This system also optionally further includes at least one additional builder and preferably two or more additional builders as an additional builder system which is present in an amount from about 2 to 10% by weight of the composition. The additional builder system may be selected from the group consisting of the salts of hexamethylenediamine tetraacetic acid, the salts of diethylenetriamine pentaacetic acids, alkali silicates, and mixtures thereof.

Additionally, anionic surfactants are also useful in the present invention, but not in a preferred embodiment. The anionic surfactants are useful in a range of from about 2 to 25% by weight of the composition and preferably at about 5% by weight of the composition. The anionic surfactants include at least one anionic surfactant selected from the group consisting of alkali metal, ammonium, and $C_1$ to $C_4$ alkylammonium salts of fatty acids having a carbon content of from about $C_{10}$ to $C_{20}$, water soluble salts such as alkali metal, ammonium and $C_1$ to $C_4$ alkylammonium salts of organic sulfuric reaction products having an alkyl group containing from about $C_{10}$ to $C_{20}$ carbon content, and a sulfonic or sulfuric acid ester group.

Other useful anionics include the water soluble salts of the esters of alpha sulfonated fatty acids having a carbon content of about $C_6$ to $C_{20}$ in the fatty acid groups and from about $C_1$ to $C_{10}$ carbon content in the ester groups.

Other water soluble salts useful in the present invention include the water soluble salts of 2-acyloxyalkane-1-sulfonic acids containing from about $C_2$ to $C_9$ carbon content in the acyl group and about $C_9$ to $C_{23}$ carbon content in the alkane alkyl ether sulfates containing from about $C_{10}$ to $C_{20}$ carbon atoms in the alkyl groups and from about 1 to 30 moles of ethylene oxide, water soluble salts of olefin sulfonates containing from about $C_{12}$ to $C_{24}$ carbon content, beta-alkyloxyalkane sulfonates which contain from about $C_1$ to $C_3$ carbon content in the alkyl group and from about $C_8$ to $C_{20}$ carbon content in the alkane, anionic phosphate surfactants, N-alkyl substituted succinamates, and mixtures thereof.

The composition may also optionally further include a pH adjuster to keep the liquid detergent near neutral or slightly alkaline in pH value. If the pH is over 9, then salting out of the builder may occur at higher builder levels such as at 10% or more by weight of the builder in the composition. The preferred pH ranges are from about 6 to 9, more preferably from about 7 to 8.5, and most preferably at about 8. The pH adjusters may be selected from any compatible acid compound and citric acid is especially preferred because of its builder properties. The pH adjusters are present in a range of from about 0.1 to 5% by weight of the composition.

Further, and surprisingly, the liquid laundry detergent composition may also further include at least one cationic quaternary ammonium fabric softener selected from the group consisting of:

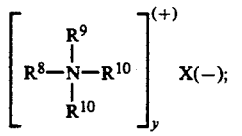

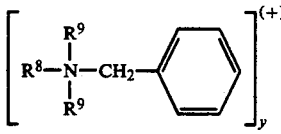

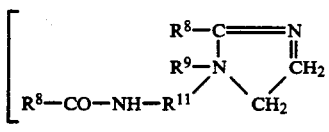

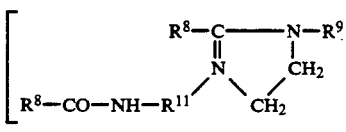

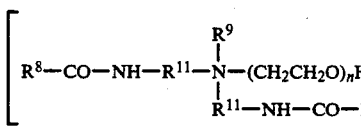

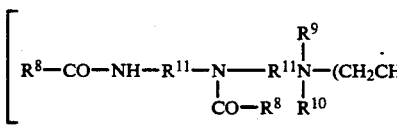

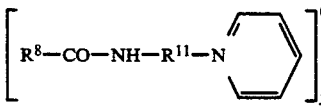

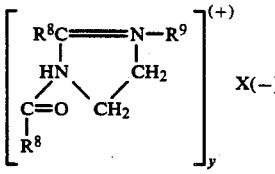

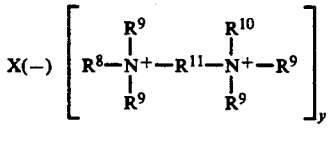

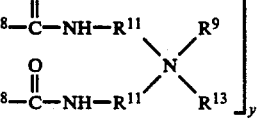

Another example is the reaction product of about 2 moles of an acid having the formula $R_5COOH$ and about 1 mole of an alkylene diamine having the formula $H_2N—C_2H_4-NHR_6$, said reaction product being a mixture of amides, esters, imidazolines and mixtures thereof.

In the foregoing formulas, $R^8$ is an alkyl or alkenyl straight or branched chain hydrocarbon containing from 8 to 22, preferably from 11 to 19 carbon atoms. $R^9$ is an alkyl group containing from 1 to 3 carbon atoms. $R^{10}$ represents $R^8$ or $R^9$. $R^{11}$ is a divalent alkylene group containing from 1 to 2 carbon atoms. $R^{12}$ is an aliphatic alkyl group containing from 15 to 19 carbon atoms. $R^{13}$ is a hydroxyalkyl group containing from 1 to 3 carbon atoms. X is a suitable anion such as chloride, bromide, iodide, sulfate, alkylsulfate having 1 to 3 carbon atoms in the alkyl group, acetate, etc. Also in the formulas, y is the valence of X and n represents an integer from 1 to 4. Mixtures of quaternary ammonium compounds may also be used to practice this invention.

Cationic fabric softeners are basically, one, two or three alkyl chains emanating from a positively charged cation such as nitrogen or phosphorus. The alkyl groups are usually $C_{10}$–$C_{22}$. These materials must be water soluble or water dispersible. The positively charged nitrogen can be a normal alkyl ammonium or in a cyclic ring such as imidazolinium or pyridinium salts. Examples of some of the more common commercial classes of cationic fabric softeners are monoalkyl trimethyl quaternary ammonium compounds, monomethyl trialkyl quaternary ammonium compounds, dimethyl dialkyl quaternary ammonium compounds, imidazolinium quaternary ammonium compounds, dimethyl alkyl benzyl quaternary ammonium compounds, complex diquaternary ammonium compounds, dimethyl dialkoxy alkyl quaternary ammonium compounds, diamidoamine based quaternary ammonium compounds, dialkyl methyl benzyl quaternary ammonium compounds, alkyl pyridinium salts, and amido alkoxylated ammonium. Usually these commercial quaternary ammonium compounds contain alkyl groups of $C_{10}$–$C_{18}$ or a mixture thereof. To obtain clear solutions, use of an alcohol such as ethanol may improve the clarity of the composition if the composition is clear before addition of the cationic fabric softener compound.

It has been surprisingly found that cationic quaternary fabric softeners may be tolerated in these detergent compositions to produce stable, one phase compositions. Some compositions are translucent to opaque in appearance depending upon the formulation employed. More preferred compositions are those which are found to be as clear in appearance as those which are free of such cationic fabric softeners.

The composition may also include proteolytic enzymes in an amount of 0.01 to 5% by weight of the composition, optical brighteners in an amounts of about 0.05 to 5% by weight of the composition as well as perfumes, dyes, disinfectants and other ingredients which are standard and well known in the art.

Preferably, the composition is comprised of from about 10% to 25% by weight of at least one nonionic surfactant such as an ethoxylated nonylphenol surfactant, at least one builder which is preferably a salt of nitrilotriacetic acid along with a borate builder present in an amount of about 2 to 25% by weight of the composition and more preferably at about 5% to 10% by weight of the composition, optionally, an additional builder system in an amount of about 2 to 10% by weight of the composition, a water soluble polymeric anionic hydrotrope anti-redeposition agent which is a hydrolyzed $C_6$ to $C_{10}$ alpha olefin and maleic anhydride copolymer which is present in an amount effective to render the built liquid detergent composition clear, stable and single phase, typically at about 1 to 10%, and more preferably from 2% to 5%, by weight of the composition, optionally a pH adjuster present in about 0.1 to 5% by weight of the composition as well as optionally effective amounts of proteolytic enzymes, optional cationic quaternary ammonium fabric softeners of the aforementioned type, and the balance of the composition being water. It is further contemplated that the composition have a pH in a range of about 6 to 9, more preferably from about 7 to 8.5, and most preferably at about 8.

The following Examples are offered to illustrate the invention and facilitate its understanding without limiting the scope or spirit of the invention.

In the Examples, the testing reported was done substantially in accordance with the American Association of Textile Chemists and Colorists (AATCC) method for measuring soil removal from artificially soiled fabrics (AATCC Method No. 153-1978) and for evaluating stain removal performance in home laundry (AATCC Method No. 130-1981). When reported, the formulations were tested according to the guidelines as set forth by the AATCC as these test methods relate to soil redeposition (AATCC Method No. 152-1980).

In the following Examples, the ingredients listed were as follows unless otherwise indicated and the amounts and percentages used are by weight:

ADOL® 42—Tallow alcohol, from Sherex Chemical Company.

Ammonium Hydroxide—concentrated, 30% ammonia, 26° Baume.

EDTA—Ethylenediamine tetraacetic acid

LAAS—Linear sodium alkyl aryl sulfonate, 60% in water.

MILEZYME® APB—blend of protease and amylase in liquid form from Miles Biotech Products Division of Miles Laboratories, Inc.

MYCON P200—Ethylenediamine tetra(methylene phosphonic acid) from Warwick International Ltd., free acid in cake form.

MYCON P240—Hexapotassium salt of Ethylenediamine tetra(methylene phosphonic acid), from Warwick International Ltd., 27% in water.

NEODOL® 25-7—Polyethylene glycol ether of a mixture of synthetic $C_{12}$–$C_{15}$ fatty alcohols with an average of 7 moles of ethylene oxide from Shell Chemical Company.

NEODOL® 25-9—Polyethylene glycol ether of a mixture of synthetic $C_{12}$–$C_{15}$ fatty alcohols with an average of 9 moles of ethylene oxide from Union Carbide.

NTA Salt—Trisodium salt of nitrilotriacetic acid ("NTA"), 40% in water.

STPP—Sodium tripolyphosphate, anhydrous granules.

SURFONIC® N-60—Ethoxylated alkylphenol of formula $C_9H_{19}C_6H_4$-$(OCH_2CH_2)_bOH$ where b averages 6, from Texaco Chemical Corporation.

SURFONIC® N-95—Same as SURFONIC N-60, but b averages 10 instead of 6.

SXS—Sodium xylene sulfonate, 40% in water.

TERGITOL® 15-S-9—Polyethylene glycol ether of a mixture of synthetic $C_{11}$–$C_{15}$ fatty alcohols with an average of 9 moles of ethylene oxide, from Shell Chemical Co.

TINOPAL® CBS—Distyrylbiphenyl derivative from CIBA-GEIGY, optical brightener agent.

TINOPAL® PT—Benzenesulfonic acid, 2,2'-(1,2-ethandiyl) bis(5-(4-(bis(2-hydroxyethyl) amino)-6-((4-sulfophenyl) amino)1,3,5-triazin-2-yl)amino)-tetrasodium salt from CIBA-GEIGY, optical brightening agent.

TKPP—Tetrapotassium pyrophosphate, 60% in water or 100% as indicated in the Examples.

TRITON® QS30—Phosphonate surfactant in free acid form, from Rohm & Haas Co.

EXAMPLES 1-7

In the following Table I, the formulations listed are given as parts by weight of nonvolatile ingredients. The alpha olefin/maleic anhydride polymers listed are to be added as 15% by weight solutions of the polymer hydrolyzed with sodium hydroxide (150% of stoichiometric amount) in water.

TABLE I

| Ingredient | 1 | 2 | 3 | 4 | 5 | 6 | 7 |
|---|---|---|---|---|---|---|---|
| 1-hexene/maleic anhydride copolymer (1.0/1.0 molar ratio) | 3.00 | — | 4.00 | 4.00 | — | 5.00 | — |
| 1-hexene/1-decene/maleic anhydride terpolymer (.5/.5/1.0 molar ratio) | — | 2.50 | — | — | 6.00 | — | — |
| 1-decene/1-octadecene/maleic anhydride terpolymer (.5/.5/1.0 molar ratio) | — | — | — | — | — | — | 4.00 |
| Sodium hydroxide | 1.00 | 0.7 | 1.33 | 1.33 | 1.68 | 1.67 | 0.82 |
| Borate-sodium tetraborate | 5.00 | — | 3.00 | 5.00 | 20.00 | 4.00 | 3.00 |
| Tetrapotassium pyrophosphate (TKPP) | — | 5.00 | — | — | — | 9.00 | — |
| Nitrilotriacetic acid (NTA), trisodium salt (NTA salt) | 4.00 | — | 5.00 | — | 2.50 | — | — |
| Sodium citrate | — | 2.50 | — | — | — | — | 5.00 |
| Primary alcohol ethoxylate (9 mol) | 15.00 | — | — | 9.00 | — | 12.00 | 15.00 |
| Secondary alcohol ethoxylate (7 mol) | — | 12.00 | — | 4.00 | — | — | — |
| Ethoxylated (9.5 mol) nonylphenol | — | — | 15.00 | — | 10.00 | — | — |
| Citric acid | 1.75 | 1.20 | 1.50 | — | 2.50 | 2.00 | 1.20 |
| Optical brightener | .20 | .20 | .20 | .30 | .15 | .15 | .30 |
| Methyl bis 2-hydroxyethyl ammonium sulfate | — | — | — | 3.20 | — | — | — |
| Fragrance | .20 | .20 | .20 | .20 | .20 | .20 | .20 |
| Dye | .002 | .002 | .002 | .002 | .002 | .002 | .002 |
| Enzyme | .50 | — | — | — | — | — | .50 |
| Water (balance to 100%) | | | | | | | |

Example 1 indicates the use of a $C_6$ alpha olefin/maleic anhydride copolymer having a borax and an NTA salt builder system along with an enzyme for protein removal. The formula is expected to have excellent stain removal, especially grass and blood stain removal, on 100% cotton and blends of cotton and polyester when tested according to the test methods enumerated above.

Example 2 demonstrates the use of a $C_6$–$C_{10}$ alpha olefin/maleic anhydride terpolymer. The formulation of Example 2 does not contain a trisodium NTA salt/borax builder system. However, it does contain an optional builder system for use where use of NTA and/or its salts is not permitted by law. The system is expected to give good performance overall, however it is expected to have a slightly downscale detergency value relative to formulations using a 50:50 weight ratio of trisodium NTA salt and borax at the same total percentage in the formulation.

Example 3 demonstrates the use of an ethoxylated nonylphenol surfactant because use of such a surfactant greatly increases oily stain and particulate soil removal. This formulation, using a $C_6$ alpha olefin/maleic anhydride copolymer, is preferred when one desires to obtain a formulation giving optimum detergency, anti-redeposition properties and oily stain removal.

Example 4 demonstrates the incorporation of a cationic quaternary ammonium fabric softener into compositions of the present invention.

Example 5 indicates increasing the borax builder system to improve the whiteness readings of fabrics when they are washed with such a composition.

Example 6 indicates a combination of borax along with tetrapotassium pyrophosphate as a builder system and a $C_6$ alpha olefin/maleic anhydride copolymer in a detergent composition. The composition is expected to offer excellent anti-redeposition and stain removal properties.

Example 7 indicates the use of a $C_{10}$–$C_{18}$ alpha olefin/maleic anhydride terpolymer and is expected to demonstrate very good stain removal. Anti-redeposition properties are expected to be slightly downscale when compared with a similar formulation using, for example, a $C_6$ alpha olefin/maleic anhydride copolymer substituted for the $C_{10}$–$C_{18}$ alpha olefin/maleic anhydride polymer in Example 7, but is still expected to fall within the acceptable range for anti-redeposition properties.

PROCESSING EXAMPLES

The alpha olefin/maleic anhydride polymer used in this invention is hydrolyzed with sodium tetraborate, ammonium hydroxide, potassium hydroxide, or sodium hydroxide, and more preferably with sodium hydroxide. A concentrate is prepared with water, base, and polymer at a temperature of 40° C.–95° C. until a clear solution is formed.

| Processing Example A: | |
|---|---|
| Polymer Cut #1 | % by Weight |
| Water | 70.0 |
| Sodium tetraborate | 10.0 |
| 1-hexene/maleic anhydride copolymer | 20.0 |
| | 100.0 |

PROCESSING FOR EXAMPLE 1

Charge 59.848 grams of water together with 3.5 grams of sodium tetraborate and 1.75 grams of citric acid. Agitate until dissolved. Add 15 grams of the polymer cut shown above. Add the rest of materials in the following order: 15.0 grams of primary alcohol ethoxylate, 0.020 grams of optical brightener, 0.50 grams of enzyme, 4.0 grams of trisodium NTA, 0.002 grams of dye, and 0.20 grams of fragrance.

| Processing Example B: | |
|---|---|
| Polymer Cut #2 | % by Weight |
| Water | 70.0 |
| Ammonium Hydroxide | 10.0 |

-continued

| Processing Example B: | |
|---|---|
| Polymer Cut #2 | % by Weight |
| 1-hexene/maleic anhydride copolymer | 20.0 |
| | 100.0 |

PROCESSING FOR EXAMPLE 4

Charge 58.229 grams of water with 5.0 grams of sodium tetraborate. Add 20.0 grams of Polymer Cut #2 shown above. Agitate until dissolved. Meanwhile, heat 9.0 grams of primary alcohol ethoxylate and 4.0 grams of secondary alcohol ethoxylate with 3.2 grams of methyl bis 2-hydroxyethyl ammonium sulfate to 100° F. Slowly add the heated surfactants to the water, sodium tetraborate, and Polymer Cut #2 mixture until uniform. Add 0.30 grams of optical brightener, 0.001 grams of dye, and 0.20 grams of fragrance.

There is an amide formation up to 30% with a polymer or resin cut prepared with ammonium hydroxide. Performance is similar to cuts prepared with sodium hydroxide, potassium hydroxide, and sodium tetraborate.

EXAMPLES 8–14

In the following Examples, a polymer or "resin" cut was made by hydrolyzing the maleic anhydride/alpha-olefin polymers using sodium hydroxide and water. Unless otherwise noted, all amounts and percentages are by weight. Thus, 7.5 parts of sodium hydroxide was mixed with 77.5 or 72.5 parts of water and 15 or 20 parts, respectively, of maleic anhydride/alpha-olefin polymer and heated at 40°–95° C. until a clear solution was formed thereby providing a resin cut having 15% or 20% polymer content. The following abbreviations are used below when referring to the maleic anhydride copolymers or terpolymers used in the form of "resin cuts":

MAH/$C_4$—1:1 molar ratio copolymer of maleic anhydride:1-butene, resin cut at 15% copolymer content.

MAH/$C_4$/$C_{10}$—1:0.5:0.5 molar ratio terpolymer of maleic anhydride:1-butene:1-decene, resin cut at 15% terpolymer content.

MAH/$C_6$—1:1 molar ratio copolymer of maleic anhydride: 1-hexene, resin cut at 20% copolymer content.

MAH/$C_6$/$C_{10}$–1:0.5:0.5 molar ratio terpolymer of maleic anhydride:1-hexene:1-decene, resin cut at 15% terpolymer content.

MAH/$C_{10}$1:1 molar ratio copolymer of maleic anhydride: 1-decene, resin cut at 15% copolymer content.

Example 8 was a comparative Example prepared to reproduce Example 11 of the Smith et al. U.S. Pat. No. 4,525,291 containing sodium xylene sulfonate as a hydrotrope and to compare that composition with compositions substituting maleic anhydride/alpha-olefin copolymers as hydrotropes (Examples 9–12). Example 9 containing the MAH/$C_4$ copolymer was a comparative Example based upon a combination of the teachings of the Tuvell U.S. Pat. No. 3,235,505 (which employs substantially equimolar copolymers of maleic anhydride with an olefinically unsaturated compound having less than 5 carbon atoms) in view of the Smith et al. patent's teachings even though the Tuvell Patent relates to an emulsion built liquid detergent composition reported to be "very white" in Tuvell's Example I rather than being clear.

TABLE II

| | Example No. | | | | | | |
|---|---|---|---|---|---|---|---|
| | 8 | 9 | 10 | 11 | 12 | 13 | 14 |
| TERGITOL 15-S-9 | 7.0 | 7.0 | 7.0 | 7.0 | 7.0 | 7.0 | 7.0 |
| SXS | 12.50 | — | — | — | — | 40.99 | — |
| MAH/$C_4$ Resin Cut | — | 33.33 | — | — | — | — | 60.32 |
| MAH/$C_6$ Resin Cut | — | — | 25.00 | — | — | — | — |
| MAH/$C_{10}$ Resin Cut | — | — | — | 33.33 | — | — | — |
| MAH/$C_4$/$C_{10}$ Resin Cut | — | — | — | — | 33.33 | — | — |
| TRITON QS30 | 3.33 | 3.33 | 3.33 | 3.33 | 3.33 | 3.33 | 3.33 |
| TKPP[1] | 25.00 | 25.00 | 25.00 | 25.00 | 25.00 | 25.00 | 15.00 |
| Deionized Water | 28.08 | 7.25 | 15.58 | 7.25 | 7.25 | — | — |
| MYCON P240 | 0.56 | 0.56 | 0.56 | 0.56 | 0.56 | — | — |
| MYCON P200 | — | — | — | — | — | 0.15 | 0.15 |
| Sodium Gluconate | 0.20 | 0.20 | 0.20 | 0.20 | 0.20 | 0.20 | 0.20 |
| $H_2O_2$[2] | 23.33 | 23.33 | 23.33 | 23.33 | 23.33 | 23.33 | 14.00 |
| Appearance[3] | S | S | C | C | C | S | S |

[1]Tetrapotassium pyrophosphate, 60% in water for Examples 8–13 and 100% for Example 14.
[2]Hydrogen Peroxide, 30% in water for Ex. 8–13 and 50% in water for Ex. 14.
[3]Composition at room temperature (about 23–25° C.) within about 24 hours after formulation; S = separated into two phases; C = clear, one phase.

As can be seen from Table II, comparative Examples 8 and 9 were unstable and separated into two phases shortly after they were made. Example 10, using an MAH/$C_6$ copolymer resulted in a clear, solvated, single phase composition as did Example 11 having an MAH/$C_{10}$ copolymer. Example 12 shows that $C_4$ alpha olefin can be employed to produce clear, solvated, single phase compositions of the present invention as long as another higher 1-alkene is also a significant part of the total alpha olefin content of the terpolymer.

Comparative Examples 13 and 14 were produced to determine if increasing the amount of hydrotrope in Examples 8 and 9 would produce clear, solvated, single phase compositions. MYCON P200 (free acid) was used instead of MYCON P240 in these Examples, 100% TKPP and 50% hydrogen peroxide solution was used in Examples 13 and 14. Example 13 contained 16.4% sodium xylene sulfonate and Examples 14 contained 9.05% MAH/$C_4$ copolymer. Both samples separated into two phases upon standing at room temperature.

Thus, to obtain clear, one phase, solvated built liquid detergent compositions, an MAH/$C_6$ or higher 1-alkene copolymer appears to be necessary to act as a hydrotrope. However, polymers including a $C_4$ 1-alkene can be employed as hydrotropes if there is further included a sufficient amount of higher 1-alkene such as a 1-decene, i.e., a MAH/$C_4$/$C_{10}$ terpolymer.

EXAMPLES 15–22

In these Examples, polymers having substantially equimolar ratios of maleic anhydride to alpha olefins were evaluated as hydrotropes in built liquid detergent compositions. Examples 16–21 were clear, one phase solvated built liquid compositions while Example 15 was a comparative Example since it separated into two phases.

In these Examples, the resin cuts used were:

MAH/$C_4$/$C_6$—1:0.5:0.5 molar ratio terpolymer of maleic anhydride:1-butene:1-hexene; resin cut was 15% polymer, 5% sodium hydroxide and 80% tap water.

MAH/$C_6$/$C_{10}$—1:0.5:0.5 molar ratio terpolymer of maleic anhydride:1-hexene:1-decene; resin cut was 20% polymer, 25% borax, and 55.0% deionized water.

MAH/$C_6$/$C_{18}$—1:0.9:0.1 molar ratio terpolymer of maleic anhydride:1-hexene:1-octadecene; resin cut was 15% polymer, 5% sodium hydroxide and 80% tap water.

MAH/$C_{10}$/$C_{18}$—1:0.5:0.5 molar ratio terpolymer of maleic anhydride:1-decene:1-octadecene; resin cut was 25% polymer, 10.3% ammonium hydroxide, and 64.7% deionized water.

MAH/$C_{12}$—1:1 molar ratio copolymer of maleic anhydride and 1-dodecene; resin cut was 20% polymer, 9.13% Ammonium Hydroxide and 70.87% deionized water.

MAH/$C_{14}$—1:1 molar ratio copolymer of maleic anhydride and 1-tetradecene; resin cut was 20% polymer, 8.26% Ammonium Hydroxide and 71.24% deionized water.

MAH/$C_{18}$—1:1 molar ratio copolymer of maleic anhydride and 1-octadecene; resin cut was 15% polymer, 5% sodium hydroxide and 80% tap water.

The formulations employed are listed in Table III. Each composition was prepared by mixing the ingredients listed together sequentially and in the order listed in Table III with stirring. In Examples 19 and 20, the order of addition was deionized water, TINOPAL CBS, polymer cut, borax, SURFONIC N-95, NTA salt, dye (as a 1% solution in water) and citric acid.

The MAH/$C_4$/$C_6$ polymer had an average of about 5 carbon atoms based on the total alpha olefin content. The result was a two phase composition. The remaining compositions were clear, single phase, solvated compositions. Examples 18, 19 and 20 were observed to be more viscous than the other compositions and Examples 19 and 20 were noted as being very viscous, i.e., very thick, but still pourable.

TABLE III

| | Example No. | | | | | | |
|---|---|---|---|---|---|---|---|
| | 15 | 16 | 17 | 18 | 19 | 20 | 21 |
| Tap Water[1] | 53.33 | 58.9 | 52.83 | 53.2 | 52.7 | 52.7 | 52.13 |
| Borax | 2.0 | — | 2.0 | 5.0 | 5.0 | 5.0 | 2.0 |
| Citric Acid | — | 1.1 | 0.50 | 1.8 | 1.8 | 1.8 | 0.5 |
| MAH/$C_4$/$C_6$ Resin Cut | 26.67 | — | — | — | — | — | — |
| MAH/$C_6$/$C_{10}$ Resin Cut | — | 20.0 | — | — | — | — | — |
| MAH/$C_6$/$C_{18}$ Resin Cut | — | — | 26.67 | — | — | — | — |
| MAH/$C_{10}$/$C_{18}$ Resin Cut | — | — | — | 20.0 | — | — | — |
| MAH/$C_{12}$ Resin Cut | — | — | — | — | 20.0 | — | — |
| MAH/$C_{14}$ Resin Cut | — | — | — | — | — | 20.0 | — |
| MAH/$C_{18}$ Resin Cut | — | — | — | — | — | — | 26.67 |
| SURFONIC N-60 | — | — | — | — | — | — | 6.0 |
| SURFONIC N-95 | 12.0 | — | 12.0 | 15.0 | 15.0 | 15.0 | 6.0 |
| ADOL 42 | — | 15.0 | — | — | — | — | — |
| NTA Salt | 6.0 | 5.0 | 6.0 | 5.0 | 5.0 | 5.0 | 6.0 |
| TINOPAL CBS | — | — | — | — | 0.3 | 0.3 | 0.25 |
| C.I. Direct Blue 86 Dye (1%) | — | — | — | — | 0.2 | 0.2 | 0.2 |
| Fragrance | — | — | — | — | — | — | 0.25 |
| Appearance[2] | S | C | C | C, V | C, V | C, V | C |

[1]Deionized water was used for Examples 19 and 20.
[2]Composition at room temperature within about 24 hours after formulation: S = Separated into two phases, C = clear, one phase; V = viscous.

EXAMPLES 22–23

In these comparative Examples, two built liquid detergent compositions were prepared without the use of an additional hydrotrope agent to show that certain formulations can be made which are stable and clear at room temperature.

Example 22 was based on Example 55 of the Smith et al. '291 Patent. It is known that some formulations do provide clear, one phase built liquid detergent compositions without the addition of hydrotropes. In Example 22, the 6% of sodium xylene sulfonate and 7% of hydrogen peroxide solution listed in Example 55 of the Smith et al. '291 Patent was omitted and water was substituted in their place. Ethylene diamine tetraacetic acid ("EDTA") was used in place of hexapotassium ethylenediamine tetra(methylene phosphonate). The formulation for Example 22 is listed in TABLE IV.

Example 22 was stable and clear at room temperature at the time the composition was prepared without the use of any additional hydrotrope agent. This formulation did contain ethanol which is a known cosolvent and 6% of an anionic surfactant as well as a relatively low amount of nonionic surfactant.

Example 23 did not contain any ethanol cosolvent or surfactants other than the one nonionic surfactant, SURFONIC N-95. This sample was clear and remained in a single phase after being prepared and remained so upon storage at room temperature. However, Example 23 immediately separated into two phases when its temperature reached 120° F. after the sample was placed in an oven for stability testing. Another comparative Example was prepared using the formula of Example 23, but substituting 1.0% MILEZYME APB in place of 1% of the water in the formulation and the same results were observed: the sample was clear and single phase at room temperature, but separated into two phases upon being heated to 120° F.

Other compositions have also been prepared which are clear and stable without additional hydrotrope agent, the results are dependent upon the nature and amount of the builder salts and surfactants present. Stability upon heating which can occur during shipment and storage of such compositions can become a problem. The polymeric anionic hydrotropes of the present invention can help in reducing this temperature sensitivity. In any event, it is expected that when a polymeric anionic hydrotrope agent of the present invention is added to such a clear composition, it is expected that the anti-redeposition characteristics of the formulation will be improved.

TABLE IV

| | Example No. | |
|---|---|---|
| | 22 | 23 |
| Deionized Water | — | 67.8 |
| TINOPAL CBS | — | 0.2 |
| Borax | — | 5.0 |
| SURFONIC N-95 | — | 20.0 |
| NEODOL 25-9 | 4.0 | — |
| LAAS (60%) | 10.0 | — |
| NTA Salt | 15.0 | 5.0 |
| Ethanol | 10.0 | — |
| Sodium Gluconate | 0.2 | — |
| EDTA | 0.15 | — |
| Deionized Water | 60.65 | — |
| Direct Blue 86 (1%) | — | 0.2 |
| Citric Acid | — | 1.8 |

The compositions were prepared by mixing the ingredients listed in TABLE IV together in the order shown with stirring, allowing each ingredient to dissolve or disperse before the next ingredient was added.

EXAMPLE 24–28

These Examples use a base formulation containing reasonably high levels of both builder salts (TKPP and sodium citrate) and nonionic surfactants to demonstrate the differences in stain removal for compositions containing sodium xylene sulfonate as a hydrotrope (Example 24) and MAH/$C_4$ copolymer (Example 25) as hydrotropes versus MAH/$C_4$/$C_{10}$ terpolymer (Example 26), MAH/$C_6$ copolymer (Example 27) and MAH/$C_6C_{10}$ terpolymer (Example 28) as hydrotropes. The resin cuts used in these Examples were of the same type as those described for Examples 9–12 and 14. The formulations were listed in TABLE V.

TABLE V

| | Example | | | | |
|---|---|---|---|---|---|
| | 24 | 25 | 26 | 27 | 28 |
| Tap Water | 69.72 | 59.10 | 59.10 | 63.47 | 59.30 |
| TKPP (60%) | 8.33 | 8.33 | 8.33 | 8.33 | 8.33 |
| Citric Acid | 1.20 | 1.20 | 1.20 | 1.20 | 1.20 |
| Sodium Citrate | 2.50 | 2.50 | 2.50 | 2.50 | 2.50 |
| NEODOL 25-7 | 12.00 | 12.00 | 12.00 | 12.00 | 12.00 |
| SXS (40%) | 6.25 | — | — | — | — |
| MAH/$C_4$ Resin Cut | — | 16.67 | — | — | — |
| MAH/$C_4$/$C_{10}$ Resin Cut | — | — | 16.67 | — | — |
| MAH/$C_6$ Resin Cut | — | — | — | 12.50 | — |
| MAH/$C_6$/$C_{10}$ Resin Cut | — | — | — | — | 16.67 |
| C.I. Direct Blue 86 Dye (1%) | 0.20 | 0.20 | 0.20 | 0.20 | 0.20 |
| Appearance[1] | S | S | C | 0, C | C |

[1]Composition at room temperature within about 24 hours after formulation; S = separated into two phases; 0 = opaque; C = clear, one phase; SH = slight haze.

The compositions were prepared by mixing the ingredients listed in TABLE V together in the order shown with stirring, allowing each ingredient to dissolve or disperse before the next was added.

The compositions each contained 2.5% hydrotrope, 7.5% total builder salts, and 12% nonionic surfactant. Examples 24 and 25 containing sodium xylene sulfonate and the MAH/$C_4$ copolymer both separated into two phases and are comparative Examples. The MAH/$C_6$ copolymer compositions (Example 27) was initially opaque, but appeared to be a one phase composition when it was prepared. After standing overnight, that composition became clear and remained a one phase composition. The terpolymer-containing compositions were both clear and one phase initially and remained so at room temperature. Thus, the MAH/$C_4$/$C_{10}$ terpolymer was quite effective as a hydrotrope in this formulation while the MAH/$C_4$ copolymer was not.

Each composition was vigorously shaken to insure that any separate phases were mixed together and the stain removal ability of each was tested according to standard test methods. A total of 11 agents were used to test each composition's ability to remove both water-borne and oil-borne stains from 65% polyester/35% cotton fabric swatches after one wash cycle: Columbian coffee, red lipstick, tea, chocolate, blood, Ragu' Spaghetti Sauce, clay, artificial sebum, grass, red wine and used motor oil. The test was done by having two persons separately evaluate the stain removal visually against a standard using a rating scale where 0=no stain removal to 5=complete stain removal. The two sets of individual ratings were averaged and the results are reported numerically in TABLE VI.

TABLE VI

| | Example No. | | | | |
|---|---|---|---|---|---|
| | 24 | 25 | 26 | 27 | 28 |
| Columbian Coffee | 5.00 | 5.00 | 5.00 | 5.00 | 5.00 |
| Lipstick | 1.50 | 2.00 | 2.00 | 2.25 | 2.00 |
| Tea | 5.00 | 5.00 | 5.00 | 5.00 | 5.00 |

TABLE VI-continued

| | Example No. | | | | |
|---|---|---|---|---|---|
| | 24 | 25 | 26 | 27 | 28 |
| Chocolate | 5.00 | 5.00 | 5.00 | 5.00 | 5.00 |
| Blood | 2.75 | 4.00 | 3.50 | 4.25 | 4.25 |
| Spaghetti Sauce | 2.75 | 3.25 | 3.25 | 3.25 | 3.25 |
| Clay | 4.50 | 4.25 | 3.75 | 4.50 | 4.50 |
| Sebum | 1.75 | 2.25 | 3.25 | 3.75 | 2.00 |
| Grass | 3.00 | 3.75 | 3.75 | 3.75 | 4.00 |
| Red Wine | 5.00 | 5.00 | 5.00 | 5.00 | 5.00 |
| Motor Oil (used) | 2.25 | 2.00 | 2.25 | 2.25 | 2.75 |
| AVERAGE | 3.50 | 3.77 | 3.80 | 4.00 | 3.89 |

Rating Scale:
0 = No stain removal
5 = Complete stain removal

The sodium xylene sulfonate composition (Example 24) was fairly comparable in stain removing power to the other samples although it was less effective than the other samples for lipstick, blood, sebum and grass. The MAH/$C_4$ copolymer composition (Example 25) was quite comparable in stain removal ability to the other compositions containing maleic anhydride/alpha-olefin polymers as hydrotropes.

However, the sodium xylene sulfonate and MAH/$C_4$ copolymer samples were vigorously shaken before using. If this was not done by a consumer and the product was allowed to separate into two phases before using, then cleaning ability might suffer if only part of the product was used. This result could occur if more of one phase was added than the other when the composition was added to the wash.

One phase would be expected to have a better cleaning ability for certain stains than the other since the hydrophilic salts tend to stay in one phase and the surfactants, which have some hydrophobic character, tend to associate together. The maleic anhydride/alpha-olefin polymers of the present invention permit one phase compositions to be formed.

The anti-redeposition characteristics of these compositions were also tested for gross differences between the samples by using a single washing cycle. Normally, multiple washing cycles are used, but significant differences in anti-redeposition behavior will often be evident after one wash cycle. Two different fabrics (cotton and DACRON® polyester) having one side predeposited with clay-type soil or artificial sebum were used and the other side of the cloth was left clean. Redeposition was measured using the clean or "white edge" of the sebum-soiled fabrics. The initial reflectance of the white edge (no soil present) was measured, each composition was vigorously shaken if it was not in one phase and was used to wash the cloth samples for one wash cycle. The reflectance of the white edge was again measured and the percentage difference between the two readings was calculated. Negative differences between readings would indicate that redeposition of the sebum soil was occurring. All of the compositions had positive readings and were fairly close together which indicated that the fabric sample became whiter after washing than it was before washing. Thus, no significant problem with soil redeposition for any of the compositions of Examples 24–28 tested was noted.

EXAMPLE 29

This Example shows a formulation which is preferred when one desires a built liquid laundry detergent composition made by method of the present invention which possesses a very good combination of pre-spotting characteristics, anti-redeposition characteristics and ability to remove oily stains from fabrics. The formula was as follows:

| | |
|---|---|
| Tap water | 67.848 |
| MAH/C6 Copolymer | 4.00 |
| Ammonium Hydroxide | 0.80 |
| TINOPAL CBS | 0.25 |
| Borax | 5.00 |
| SURFONIC N-95 | 15.00 |
| NTA Salt | 5.00 |
| C.I. Direct Blue 86 Dye | 0.002 |
| Citric Acid | 1.80 |
| Fragrance | 0.30 |
| | 100.000% |

The MAH/$C_6$ Copolymer is a 1:1 molar ratio copolymer of maleic anhydride and 1-hexene. The resulting composition is clear, is dyed blue, and has a pH in the range of about 7.5–8.5. Typically, such a composition is slightly viscous and the viscosity is generally between 100 and 200 centipoise at room temperature. A resin cut was prepared using the water, copolymer and ammonia solution listed before the other ingredients are added in the order listed. Sodium hydroxide can be substituted on a stoichiometric basis for the ammonium hydroxide.

EXAMPLE 30

This Example shows a formulation using a relatively economical blend of ingredients while still giving good pre-spotting, detergency and anti-redeposition characteristics. properties. The formulation was as follows:

| | |
|---|---|
| Tap Water | 53.88 |
| Borax | 2.0 |
| MAH/$C_{10X50}$ Resin Cut | 26.67 |
| SURFONIC N-60 | 6.0 |
| SURFONIC N-95 | 6.0 |
| TINOPAL CBS | 0.25 |
| STPP | 5.0 |
| Direct Blue 86 Dye (1%) | 0.2 |
| Fragrance | 0.25 |
| | 100.00% |

The resin cut used in Example 34 was composed of 15% of the MAH/$C_{10\times50}$ copolymer, 7.5% sodium hydroxide, and 77.5% water tap. The MAH/$C_{10\times50}$ copolymer used in this Example and those referred to in other Examples were about 1:5:1.0 molar ratio copolymers of maleic anhydride and 1-decene containing an excess of maleic anhydride relative to the amount of 1-decene and were of the type described in the Billman et al. Patent previously incorporated by reference.

This formulation was found to be a clear, one phase solvated liquid detergent composition which remained in one phase even after it was stored at 110° F. for 1 week as part of an accelerated stability test.

EXAMPLE 31–32

These Examples show formulations containing increased levels of NTA salts as builders along with relatively high levels of nonionic surfactants and the effect of pH on the stain removal and soil removal from artificially soiled fabric. The formulations used were as follows:

| | Example No. | |
|---|---|---|
| | 31 | 32 |
| Tap Water | 41.18 | 41.58 |
| Borax | 2.0 | 2.0 |
| MAH/$C_{10X50}$ Resin Cut[1] | 26.67 | 26.67 |
| SURFONIC N-60 | 6.0 | 6.0 |
| SURFONIC N-95 | 10.0 | 10.0 |
| TINOPAL CBS | 0.25 | 0.25 |
| NTA salt | 12.0 | 12.0 |
| Direct Blue 86 Dye (1%) | 0.20 | 0.20 |
| Citric Acid | — | 1.30 |
| Sodium Hydroxide | 1.70 | — |
| | 100.00% | 100.00% |

[1]Polymer cut, 15% in water using sodium hydroxide as alkali.

Example 31 had a pH of 10.0 and was rather alkaline. Example 32 had a pH of 7.5. Both compositions were found to be clear, one phase, solvated built liquid detergent compositions at room temperature.

The stain removal ability of each composition was evaluated after 3 wash cycles versus a commercially available built liquid detergent sold by Unilever in Canada under the tradename WISK. The commercially-obtained detergent had a pH of 12 ("CAN WISK-12") which is highly alkaline and, for test purposes, the pH of a portion of that detergent was adjusted to a pH of 7.5 ("CAN WISK-7.5"). The stain removal tests were done as described in Examples 24–28 using swatches of two different types of fabrics: 100% cotton and 65% polyester/35% cotton. The results are reported in TABLE VII. Example 31 was found to be better than Example 32 in removing blood and lipstick stains while Example 32 was found to be better than Example 31 in removing tea and red wind stains. Overall, Examples 31 and 32 were, on average, as good as the commercial WISK detergent and were better than the Canadian WISK detergent against stains on 100% cotton fabrics and were both better, on average, than either of the commercial products against stains on 65% polyester/35% cotton fabrics.

TABLE VII

| Example No. | 31 | 32 | CAN WISK-7.5 | CAN WISK-12 |
|---|---|---|---|---|
| A) 100% Cotton Fabric: | | | | |
| Columbian Coffee | 5.0 | 5.0 | 5.0 | 4.0 |
| Lipstick | 2.5 | 2.0 | 2.0 | 2.5 |
| Tea | 4.0 | 5.0 | 5.0 | 4.5 |
| Chocolate | 3.5 | 4.0 | 4.5 | 4.5 |
| Blood | 4.0 | 3.0 | 4.0 | 4.5 |
| Spaghetti Sauce | 3.5 | 3.5 | 3.5 | 3.0 |
| Clay/Dirt | 3.5 | 3.5 | 3.0 | 3.0 |
| Sebum | 3.0 | 3.0 | 2.5 | 2.0 |
| Grass | 3.5 | 3.5 | 2.5 | 3.0 |
| Red Wine | 3.0 | 4.0 | 4.5 | 2.0 |
| Motor Oil (used) | 2.5 | 2.5 | 1.5 | 2.0 |
| AVERAGE | 3.45 | 3.55 | 3.45 | 3.18 |
| B) 65% Polyester/35% Cotton Fabric: | | | | |
| Columbian Coffee | 4.5 | 5.0 | 5.0 | 4.0 |
| Lipstick | 2.5 | 2.0 | 2.5 | 2.5 |
| Tea | 4.5 | 5.0 | 5.0 | 4.0 |
| Chocolate | 5.0 | 5.0 | 5.0 | 5.0 |
| Blood | 5.0 | 4.0 | 5.0 | 5.0 |
| Spaghetti Sauce | 4.5 | 4.5 | 4.0 | 4.0 |
| Clay/Dirt | 4.5 | 4.0 | 3.5 | 4.0 |
| Sebum | 3.5 | 4.0 | 3.0 | 3.5 |
| Grass | 3.5 | 3.5 | 3.0 | 3.5 |
| Red Wine | 3.5 | 4.5 | 4.5 | 3.0 |
| Motor Oil (used) | 3.5 | 3.0 | 2.0 | 2.0 |

TABLE VII-continued

| Example No. | 31 | 32 | CAN WISK-7.5 | CAN WISK-12 |
|---|---|---|---|---|
| AVERAGE | 4.05 | 4.05 | 3.86 | 3.68 |

Rating Scale:
0 = No stain removal
5 = Complete stain removal

The detergency and anti-redeposition characteristics of each formulation were tested using 3 washing cycles following the standard testing procedure. Eight different fabric swatches for particulate soil removal testing were used. Cotton ("COTTON"), Dacron® polyester ("POLY") and 65% polyester/35% cotton ("BLEND") were purchased from Testfabrics, Inc. which were rolled on one side of the swatch with roller containing a standard oily carbon black soil. The WFK fabrics had one side deposited with clay-type soil and were purchased from Testfabrics, Inc. (WFK-COT=-cotton, WFK-BLEND=BLEND and WFK-POLY=-POLY). Likewise, POLY AND BLEND fabrics deposited with an artificial sebum mixture on one side were purchased from Testfabrics, Inc. for use herein (SEB/-POLY=POLY and SEB/BLEND=BLEND). The whiteness index values for fabrics containing clay-type soils and were thus more effective in removing such soil than the WISK detergent. Examples 31 and 32 had significantly better clay-type soil removal than did the CAN WISK-12 detergent on the BLEND and POLY fabrics.

Redeposition was measured using the clean or "white edge" of the oily-soiled fabrics. The initial reflectance of the white edge (no soil present) was measured. The swatch was then washed using the composition to be tested for 3 wash cycles. The reflectance of the white edge was again measured and the percentage difference obtained between the two readings is reported in TABLE VIII. EDGE/COT is the anti-redeposition value for cotton, "EDGE/BLEND" is the value for the BLEND fabric and "EDGE/POLY" is the value for the DACRON polyester fabric. Negative anti-redeposition values would indicate that redeposition of the oily soil was occurring. Higher anti-redeposition values indicate that the fabric appeared whiter after washing (i.e., higher reflectance values were measured) than before washing. All anti-redeposition values were positive and the readings for the BLEND and the POLY fabrics were fairly close together, indicating each formulation was comparable to the others. Examples 31 and 32 were significantly better in anti-redeposition characteristics than the CAN WISK-7.5 and CAN WISK-12 detergents on cotton fabric.

TABLE VIII

| Example No. | 31 | 32 | CAN WISK-7.5 | CAN WISK-12 |
|---|---|---|---|---|
| WFK/COT | 24.76 | 22.78 | 13.14 | 20.51 |
| WFK/BLEND | 28.38 | 27.61 | 10.69 | 17.30 |
| WFK/POLY | 23.62 | 19.54 | 7.71 | 7.46 |
| SEB/POLY | 37.36 | 34.36 | 31.00 | 34.03 |
| SEB/BLEND | 26.35 | 19.33 | 17.24 | 33.07 |
| COTTON | 26.31 | 22.67 | 34.11 | 32.95 |
| BLEND | 19.19 | 18.28 | 18.93 | 16.29 |
| DACRON | 19.59 | 18.60 | 18.85 | 14.30 |
| EDGE/COT | 23.13 | 22.32 | 18.47 | 19.73 |
| EDGE/BLEND | 3.03 | 3.01 | 3.11 | 2.40 |
| EDGE/POLY | 1.50 | 1.74 | 1.86 | 1.59 |

EXAMPLE 33

This Example illustrates a composition of the present invention employing a MAH/$C_8$ copolymer along with an enzyme additive. The MAH/$C_8$ resin cut was composed of 20.0% MAH/$C_8$ copolymer, 12.2% Ammonium Hydroxide and 67.8% deionized water where the MAH/$C_8$ copolymer was a 1:1 molar ratio copolymer of maleic anhydride and 1-octene. The composition was prepared by mixing the following in the order listed: tap water 51.4%, borax 5.0%, citric acid 1.8%, MAH/$C_8$ resin cut 20.0%, SURFONIC N-95 15.0%, TINOPAL CBS 0.3%, MILEZYME®APB 1.0%, NTA Salt 5.0%, C.I. Direct Blue 86 Dye (1%) 0.2% and fragrance 0.3%.

The resulting composition had a pH of 8.2 and was a clear, solvated, one phase composition which remained in one phase upon storage at room temperature and also upon storage at 110° F. for at least 1 week.

EXAMPLE 34

In this Example, a composition of the present invention was prepared using an MAH/$C_{10\times50}$ copolymer resin cut containing a fabric softening agent (VARISOFT® 222LT).

The MAH/$C_{10\times50}$ resin cut was composed of 20% MAH/$C_{10\times50}$ polymer, 5% sodium hydroxide and 75% deionized water. The composition was prepared by mixing the following in the order listed: tap water 43.13%, borax 2%, citric acid 0.5%, MAH/$C_{10\times50}$ resin cut 26.67%, SURFONIC N-60 6.0%, SURFONIC N-95 12.0%, TINOPAL CBS 0.25%, VARISOFT 222LT 3.0%, NTA salt 6.0%, C.I. Direct Blue 86 (1%) 0.2% and fragrance 0.25%.

The resulting composition was observed to be a clear, one phase, solvated composition which remained one phase and very uniform upon storage at room temperature. This composition exhibited good detergency. This composition was evaluated for stain removal characteristics against several commercially available liquid detergent products for comparative purposes: BOLD 3 and SOLO, both of which are sold in the United States by Procter & Gamble, neither of which were believed to contain builder salts since the addition of builder salts is generally known to cause phase separation in the products when cationic fabric softeners are included in the formulation. As an additional comparison, Example 34 was also tested against two commercially available built liquid detergent products although neither product contained a fabric softener: the CAN WISK—12 noted in Examples 31-32 and LIQUID TIDE sold in the United States by Procter & Gamble. The results obtained after one wash cycle with each composition are reported in TABLE IX. Example 34 was found to compare very favorably with the two commercial built liquid detergent products on stain removal and was significantly better than the BOLD 3 product containing cationic fabric softeners on stain removal.

TABLE IX

| Example | 34 | BOLD 3 | SOLO | LIQUID TIDE | CAN WISK-12 |
|---|---|---|---|---|---|
| A) 100% Cotton Fabric: | | | | | |
| Colombian Coffee | 4.5 | 2.0 | 4.0 | 3.5 | 3.5 |
| Lipstick | 2.0 | 3.0 | 2.5 | 3.5 | 3.5 |
| Tea | 5.0 | 4.0 | 5.0 | 4.5 | 4.5 |
| Chocolate | 4.5 | 2.5 | 4.0 | 3.5 | 3.5 |
| Blood | 3.0 | 2.0 | 3.5 | 3.5 | 3.5 |
| Spaghetti Sauce | 3.0 | 3.0 | 3.0 | 3.0 | 3.0 |

TABLE IX-continued

| Example | 34 | BOLD 3 | SOLO | LIQUID TIDE | CAN WISK-12 |
|---|---|---|---|---|---|
| Clay/Dirt | 4.0 | 3.5 | 4.0 | 3.5 | 3.5 |
| Sebum | 3.0 | 2.0 | 3.0 | 3.0 | 2.0 |
| Grass | 3.0 | 3.5 | 4.0 | 5.0 | 3.0 |
| Red Wine | 5.0 | 4.5 | 5.0 | 5.0 | 5.0 |
| Motor Oil (used) | 3.5 | 1.0 | 3.0 | 2.0 | 2.5 |
| AVERAGE | 3.68 | 2.82 | 3.73 | 3.64 | 3.41 |
| B) 65% POLY/35% COTTON FABRIC: | | | | | |
| Colombian Coffee | 5.0 | 3.5 | 4.5 | 4.5 | 4.5 |
| Lipstick | 2.0 | 3.5 | 2.5 | 2.5 | 3.0 |
| Tea | 5.0 | 4.5 | 5.0 | 5.0 | 5.0 |
| Chocolate | 5.0 | 3.0 | 5.0 | 5.0 | 5.0 |
| Blood | 4.5 | 3.0 | 5.0 | 5.0 | 5.0 |
| Spaghetti Sauce | 4.0 | 3.5 | 3.5 | 4.0 | 3.5 |
| Clay/Dirt | 5.0 | 4.0 | 5.0 | 5.0 | 5.0 |
| Sebum | 3.0 | 2.5 | 2.5 | 2.0 | 2.5 |
| Grass | 3.5 | 4.0 | 4.5 | 5.0 | 4.0 |
| Red Wine | 5.0 | 5.0 | 5.0 | 5.0 | 5.0 |
| Motor Oil (used) | 3.0 | 2.0 | 3.0 | 2.5 | 3.5 |
| AVERAGE | 4.09 | 3.50 | 4.14 | 4.14 | 4.18 |

Rating Scale:
0 = No stain removal
5 = Complete stain removal

All five compositions were then tested for anti-redeposition and particulate soil removal as was described in Examples 31-32, but only using the C.I.E. Hunter "L" readings (i.e., which does not take yellowing into account). The results are reported in Part A of TABLE X. The number of wash cycles used was 3 cycles. "CLAY COT" indicates artificial clay mixture applied to 100% cotton fabric and "CLAY BLEND" indicates artificial clay mixture applied to 65% polyester/35% cotton fabric.

Example 34, BOLD 3 AND SOLO were tested for anti-redeposition and particulate soil removal taking yellowing into account using whiteness index readings (include C.I.E. Hunter "L", "a" and "b" readings) and this testing is reported in Part B of TABLE X.

TABLE X

| Part A: Example | 34 | BOLD 3 | SOLO | LIQUID TIDE | CAN WISK-12 |
|---|---|---|---|---|---|
| WFK/COT | 13.8 | 10.5 | 16.3 | 14.2 | 14.9 |
| WFK/BLEND | 25.0 | 9.5 | 16.7 | 14.5 | 22.8 |
| WFK/POLY | 13.6 | 7.9 | 15.3 | 8.6 | 8.8 |
| SEBUM/BLEND | 8.7 | 7.5 | 10.4 | 12.5 | 9.9 |
| SEBUM/POLY | 8.7 | 11.3 | 12.5 | 9.0 | 12.2 |
| SEBUM/COT | 21.3 | 20.8 | 22.4 | 20.2 | 21.7 |
| CLAY COT | 7.5 | 8.6 | 9.3 | 7.0 | 9.6 |
| COTTON | 19.0 | 31.9 | 29.9 | 16.1 | 23.6 |
| BLEND/POLY | 16.4 | 18.4 | 19.8 | 17.2 | 17.1 |
| POLY | 24.2 | 21.3 | 19.7 | 15.4 | 22.8 |
| EDGE/COT | 0.2 | 1.0 | 0.8 | 0.6 | 0.6 |
| EDGE/BLEND | 1.8 | 1.6 | 1.8 | 1.7 | 1.9 |
| EDGE/POLY | 1.7 | 1.7 | 1.6 | 1.7 | 1.7 |

| Part B: Example | 34 | BOLD 3 | SOLO |
|---|---|---|---|
| CLAY BLEND | 20.36 | 23.95 | 13.81 |
| SEBUM/POLY | 38.58 | 25.50 | 22.70 |
| SEBUM/COT | 27.41 | 25.83 | 18.25 |
| SEBUM/BLEND | 18.47 | 15.38 | 12.61 |
| WFK/COT | 23.97 | 19.20 | 14.48 |
| WFK/BLEND | 29.12 | 13.87 | 12.84 |
| WFK/POLY | 22.22 | 7.43 | 9.66 |
| COTTON | 22.19 | 17.62 | 15.51 |
| POLY | 21.26 | 17.00 | 12.29 |
| EDGE/COT | 20.17 | 12.17 | 10.74 |
| EDGE/POLY | 0.63 | 0.43 | 0.26 |

In TABLE X, Part A, except for the COTTON and CLAY COTTON entries, the composition of Example 34 was comparable to the two commercial built liquid detergent products that did not contain fabric softener (LIQUID TIDE and CAN WISK-12) in particulate soil removal and anti-redeposition characteristics and significantly better than those two commercial products on particulate soil removal from clay-soiled BLEND fabrics. In TABLE X, Part A, the composition of Example 34 was comparable to the two commercial built liquid detergent products that did contain fabric softener (BOLD 3 AND SOLO) in particulate soil removal and anti-redeposition characteristics. In the more demanding testing regimen used reported in TABLE X, Part B, except for the BOLD 3 CLAY BLEND entry, the composition of Example 34 was better than the two commercial products containing fabric softening agents in particulate soil removal and anti-redeposition characteristics.

EXAMPLES 35–37

These Examples demonstrate the effect of varying the builder salt and surfactant system of enzyme-containing compositions of the present invention on stain removal ability. Example 36 further provides an example of a composition containing an anionic surfactant in addition to nonionic surfactants.

The MAH/$C_6$/$C_{10}$ resin cut was composed of 20% MAH/$C_6$/$C_{10}$ polymer, 12.2% Ammonium Hydroxide and 67.8% deionized water wherein the MAH/$C_6$/$C_{10}$ polymer was a 1:0.5:0.5 polymer of maleic anhydride, 1-hexene and 1-decene. The formulations are listed in TABLE XI. The stain removal results obtained after 1 wash cycle for each composition are listed in TABLE XII. TABLE XII shows that all three compositions tested had relatively the same amount of stain removal ability.

TABLE XI

| | Example No. | | |
|---|---|---|---|
| | 35 | 36 | 37 |
| Tap water | 51.8 | 47.8 | 54.8 |
| Borax | 5.0 | 5.0 | 5.0 |
| Citric Acid | 2.0 | 2.0 | 2.0 |
| MAH/$C_6$/$C_{10}$ Resin Cut | 20.0 | 20.0 | 20.0 |
| LAAS (60%) | — | 7.0 | — |
| SURFONIC N-95 | 15.0 | 17.0 | 12.0 |
| TINOPAL CBS | 0.3 | 0.3 | 0.3 |
| MILEZYME APB | 0.5 | 0.5 | 0.5 |
| NTA Salt | 5.0 | — | — |
| STPP | — | — | 5.0 |
| C.I. DIrect Blue 86 (1%) | 0.2 | 0.2 | 0.2 |
| Fragrance | 0.2 | 0.2 | 0.2 |

TABLE XII

| | 100% Cotton Fabric | | | 65% POLY/ 35% Cotton Fabric | | |
|---|---|---|---|---|---|---|
| Example No. | 35 | 36 | 37 | 35 | 36 | 37 |
| Colombian Coffee | 5.0 | 5.0 | 5.0 | 5.0 | 5.0 | 5.0 |
| Lipstick | 2.5 | 2.0 | 2.0 | 3.5 | 3.5 | 3.5 |
| Tea | 5.0 | 5.0 | 5.0 | 5.0 | 5.0 | 5.0 |
| Chocolate | 4.5 | 4.0 | 4.5 | 5.0 | 4.0 | 4.5 |
| Blood | 4.5 | 4.0 | 4.0 | 5.0 | 5.0 | 5.0 |
| Spaghetti Sauce | 2.5 | 2.5 | 3.0 | 4.0 | 4.0 | 3.5 |
| Clay/Dirt | 4.0 | 3.5 | 4.5 | 5.0 | 4.5 | 5.0 |
| Sebum | 3.0 | 3.5 | 3.5 | 4.0 | 3.5 | 4.0 |
| Grass | 4.5 | 4.0 | 4.5 | 4.5 | 4.5 | 5.0 |
| Red Wine | 5.0 | 4.5 | 5.0 | 5.0 | 5.0 | 5.0 |
| Motor Oil (used) | 2.0 | 2.0 | 2.0 | 3.0 | 2.0 | 3.0 |
| AVERAGE | 3.86 | 3.64 | 3.91 | 4.45 | 4.18 | 4.41 |

EXAMPLES 38–39

Example 38 demonstrates a composition of the present invention which contains a cationic fabric softening agent and employs MAH/$C_{10\times50}$ copolymer. Example 39 is a comparative Example that substitutes sodium xylene sulfonate as a hydrotrope in place of the MAH/$C_{10\times50}$ copolymer.

The resin cut used in Example 38 was composed of 15% of the MAH/$C_{10\times50}$ copolymer, 7.5% sodium hydroxide, and 77.5% water. Example 38 was prepared by mixing the following together with stirring in the following order: tap water 42.78%, borax 5.0%, citric acid 1.75%, NEODOL 25-9 9.0%, NEODOL 25-7 4.0%, VARISOFT 222LT 3.20%, C.I. Direct Blue Dye 86 (1%) 0.10%, NTA Salt 7.50%, and MAH/$C_{10\times50}$ resin cut 26.67%. The resulting composition was found to remain in one phase at room temperature, but was observed to be opaque rather than crystal clear in appearance.

Example 39 had the same formula as Example 38 but used 59.4% tap water and 1.8% citric acid. Ten percent of a sodium xylene sulfonate solution (40% in water) was substituted for the 26.67% amount of MAH/$C_{10\times50}$ resin cut used in Example 38. The resulting composition separated into two phases at room temperature indicating that the sodium xylene sulfonate was not effective as a hydrotrope in this formulation while the MAH/$C_{10\times50}$ copolymer was effective to form a single phase composition.

EXAMPLE 40–41

These Examples provide more examples of compositions of the present invention which contain cationic fabric softening agents. These formulations were evaluated against commercially available liquid detergent compositions for stain removal characteristics. Example 40 was found to have very good pre-spotting ability and remained one phase at room temperature although it was opaque in appearance rather than clear. Example 41 was found to be opaque, but stable at both room temperature and upon storage for at least one week at 110° F.

The resin cut used to prepare Example 40 was composed of 10.2% Ammonium Hydroxide, 69.8% water and 20% of a 1:1 copolymer of maleic anhydride and 1-decene ("Resin Cut 40"). Example 40 was prepared by mixing the following together, with agitation, in order listed: deionized water 62.25%, Resin Cut 40 20.00%, VARISOFT 222LM 6.00%, SURFONIC N-95 10.00%, citric acid 1.00% and sodium hydroxide 0.75%.

The resin cut used to prepare Example 41 was composed of 10.2% Ammonium Hydroxide, 69.8% water and 20% of a 1:1 copolymer of maleic anhydride and 1-decene (hereinafter "Resin Cut 41"). Example 41 was prepared by mixing the following together, with agitation, in the order listed: deionized water 49.4%, Resin Cut 41 20.0%, borax 5.0%, C.I. Direct Blue Dye 86 (1%) 0.2%, TINOPAL PT 6.0%, SURFONIC N-95 10.0%, VARISOFT 222LT 3.0%, NEODOL 91-8 5.0% and citric acid 1.4%. In preparing Example 41, the SURFONIC N-95, VARISOFT 222LT and NEODOL 91-8 were blended together and heated to 100° F. before being added to the other ingredients.

Example 40 was evaluated for stain removal ability versus a built liquid laundry detergent sold in the United States by Procter & Gamble under the brand name "SOLO". One half cup of the composition was poured onto the fabrics containing the stains and these fabrics were placed in a washing machine along with 4 clean towels using a "medium" washing cycle with a 90° F. water temperature. Example 40 outperformed the commercial laundry detergent product in most categories of stain removal as can be seen from the data in TABLE XIII. The dry fabrics were also observed for resistance to static cling. Fabrics washed with the commercial product had good static control while fabrics washed with Example 40 had very little static control, i.e., the fabrics tended to stick together due to a buildup of static charges.

TABLE XIV

| | 100% Cotton Fabric | | 65% POLY/35% Cotton Fabric | |
|---|---|---|---|---|
| Example | 40 | SOLO | 40 | SOLO |
| Colombian coffee | 2.5 | 2.0 | 3.5 | 2.5 |
| Tea | 2.5 | 2.5 | 4.0 | 3.0 |
| Chocolate | 4.0 | 2.0 | 5.0 | 3.0 |
| Blood | 3.0 | 2.0 | 3.0 | 2.0 |
| Spaghetti Sauce | 4.0 | 4.0 | 4.5 | 4.0 |
| Clay/Dirt | 3.5 | 3.0 | 4.0 | 3.5 |
| Sebum | 3.5 | 3.0 | 4.0 | 3.0 |
| Grass | 3.0 | 3.0 | 4.0 | 4.0 |
| Rose' Wine | 5.0 | 5.0 | 5.0 | 5.0 |
| Motor Oil (used) | 2.5 | 2.5 | 3.0 | 2.0 |
| AVERAGE | 3.35 | 2.90 | 4.00 | 3.20 |

Example 41 was evaluated for stain removal ability versus the SOLO detergent noted above and two other commercial built liquid detergents sold commercially in the United States: AURA detergent that was sold by Samuel Taylor in Australia and YES detergent that was sold in the United States by Texize. One half cup of the composition was poured onto the fabrics containing the stains and these fabrics were placed in a washing machine along with 4 clean towels using a "medium" washing cycle with an 85° F. water temperature. Example 41 outperformed the commercial laundry detergent products as can be seen from the data in TABLE XIV. The dry fabrics were also observed for resistance to static cling. SOLO detergent had the most resistance to static cling followed by AURA and, lastly, by Example 41. For fabrics dried in a dryer, Example 41 gave the softest feeling to the touch while for clothesline dried fabrics, AURA detergent gave the softest feeling to the touch.

TABLE XIV

| Examples | SOLO | AURA | YES | 41 |
|---|---|---|---|---|
| A) 100% Cotton Fabrics | | | | |
| Colombian Coffee | 3.5 | 2.5 | 3.0 | 4.5 |
| Lipstick | 2.0 | 2.0 | 2.0 | 2.5 |
| Tea | 3.5 | 3.5 | 3.5 | 4.5 |
| Chocolate | 2.0 | 3.5 | 3.0 | 3.5 |
| Blood | 2.0 | 3.5 | 3.0 | 3.5 |
| Spaghetti Sauce | 4.5 | 3.5 | 3.0 | 3.5 |
| Clay | 2.5 | 3.0 | 3.5 | 3.5 |
| Sebum | 2.0 | 3.0 | 2.5 | 3.0 |
| Grass | 4.5 | 3.0 | 3.5 | 3.5 |
| Red wine | 2.5 | 1.0 | 2.5 | 4.5 |
| Motor Oil (used) | 1.0 | 2.0 | 1.5 | 2.0 |
| AVERAGE | 2.73 | 2.77 | 2.82 | 3.50 |
| B) 65% POLY/35% COTTON Fabrics | | | | |
| Colombian Coffee | 4.5 | 4.0 | 4.5 | 5.0 |
| Lipstick | 3.0 | 2.0 | 3.0 | 2.5 |
| Tea | 3.5 | 3.5 | 4.0 | 4.5 |
| Chocolate | 3.0 | 4.5 | 4.0 | 4.5 |
| Blood | 3.0 | 4.0 | 4.0 | 4.0 |
| Spaghetti Sauce | 5.0 | 4.5 | 4.5 | 4.5 |
| Clay | 3.0 | 4.5 | 4.0 | 4.0 |
| Sebum | 3.0 | 3.5 | 2.0 | 3.5 |

TABLE XIV-continued

| Examples | SOLO | AURA | YES | 41 |
|---|---|---|---|---|
| Grass | 4.5 | 4.0 | 4.0 | 4.0 |
| Red wine | 3.0 | 3.0 | 4.5 | 5.0 |
| Motor oil (used) | 2.0 | 2.5 | 1.5 | 3.0 |
| AVERAGE | 3.41 | 3.64 | 3.64 | 4.05 |

EXAMPLES 42–47

In these Examples, the stain removal, particulate soil removal and anti-redeposition characteristics of formulations made using copolymers of maleic anhydride and various 1-alkenes having an excess of maleic anhydride were evaluated.

The following copolymers were made according to the method described in the Bosanec et al. Patent previously incorporated by reference and the polymers used in these Examples, having the approximate molar ratios based on the reactants initially charged (a slight excess of the stated molar ratio is often found), are listed below:

$MAH/C_{10\times50}$—1.5:1 molar ratio copolymer of maleic anhydride:1-decene.

$MAH/C_{10\times100}$—2:1 molar ratio copolymer of maleic anhydride:1-decene.

$MAH/C_{14\times50}$—1.5:1 molar ratio copolymer of maleic anhydride:1-tetradecene.

$MAH/C_{14\times100}$—2:1 molar ratio copolymer of maleic anhydride:1-tetradecene.

$MAH/C_{18\times50}$—1.5:1 ratio copolymer of maleic anhydride and 1-octadecene.

$MAH/C_{18\times100}$—2:1 molar ratio copolymer of maleic anhydride and 1-octadecene.

The base formulation employed was as follows: tap water 42.63%; borax 2.00; Polymer Resin Cut 26.67%; SURFONIC N-60 6.00%; SURFONIC N-95 10.00%; TINOPAL CBS 0.25%; NTA Salt 12.00%; Direct Blue 86 (1%) 0.20% and fragrance 0.25%. Resin Cuts containing the following polymers were used in the base formulation to produce the indicated Example No.:

| Polymer | Example No. |
|---|---|
| $MAH/C_{10X50}$ | 42 |
| $MAH/C_{10X100}$ | 43 |
| $MAH/C_{14X50}$ | 44 |
| $MAH/C_{14X100}$ | 45 |
| $MAH/C_{18X50}$ | 46 |
| $MAH/C_{18X100}$ | 47 |

Examples 42–45 were found to be clear, single phase compositions while Examples 46–47 were found to separate into two phases at room temperature. This is in contrast to the results of Example 21 above wherein an $MAH/C_{18}$ copolymer having a 1:1 molar ratio of maleic anhydride to 1-octadecene was found to give a clear, stable phase composition in a formulation which was similar to the one used herein except that Example 21 contained about one-half the level of NTA Salt as the present formula and citric acid to adjust the pH of the composition.

Each formulation was tested for stain removal as in the previous Examples where such testing as done using two wash cycles. The results are reported in TABLE XV. Examples 46–47 were vigorously shaken before adding to the wash so that the phases would be mixed together as well as possible.

TABLE XV

| | Example | | | | | |
|---|---|---|---|---|---|---|
| | 42 | 43 | 44 | 45 | 46 | 47 |
| A) 100% Cotton Fabric: | | | | | | |
| Colombian Coffee | 4.25 | 4.25 | 3.75 | 4.25 | 3.75 | 3.75 |
| Lipstick | 2.50 | 2.25 | 2.00 | 2.75 | 3.25 | 2.75 |
| Tea | 3.75 | 5.00 | 4.00 | 3.00 | 3.75 | 2.75 |
| Chocolate | 4.00 | 4.50 | 4.50 | 4.25 | 3.00 | 3.75 |
| Blood | 4.25 | 4.25 | 3.25 | 4.50 | 4.00 | 3.50 |
| Spaghetti Sauce | 2.75 | 3.00 | 3.00 | 3.00 | 2.50 | 2.50 |
| Clay/Dirt | 2.50 | 3.25 | 3.25 | 3.25 | 2.50 | 2.50 |
| Sebum | 2.50 | 3.00 | 3.25 | 2.50 | 2.50 | 2.50 |
| Grass | 2.75 | 3.00 | 3.25 | 2.75 | 2.75 | 2.75 |
| Red Wine | 3.50 | 3.25 | 3.25 | 3.25 | 3.00 | 3.00 |
| Motor Oil (used) | 2.75 | 2.00 | 2.00 | 3.00 | 2.25 | 2.50 |
| AVERAGE | 3.23 | 3.43 | 3.23 | 3.32 | 3.02 | 2.91 |
| B) 65% POLY/35% Cotton Fabric: | | | | | | |
| Colombian Coffee | 5.00 | 5.00 | 5.00 | 5.00 | 5.00 | 5.00 |
| Lipstick | 1.25 | 3.25 | 2.25 | 1.25 | 3.25 | 2.25 |
| Tea | 4.75 | 5.00 | 5.00 | 5.00 | 4.75 | 4.75 |
| Chocolate | 4.50 | 5.00 | 5.00 | 5.00 | 5.00 | 4.75 |
| Blood | 4.75 | 5.00 | 4.25 | 4.50 | 5.00 | 4.50 |
| Spaghetti Sauce | 3.50 | 3.25 | 3.00 | 3.50 | 3.00 | 3.00 |
| Clay/Dirt | 3.75 | 4.00 | 4.00 | 3.00 | 2.75 | 3.50 |
| Sebum | 2.00 | 3.25 | 3.25 | 2.00 | 2.00 | 2.00 |
| Grass | 4.00 | 4.50 | 4.50 | 3.50 | 4.00 | 4.25 |
| Red Wine | 4.50 | 4.50 | 4.50 | 4.50 | 2.75 | 3.75 |
| Motor Oil (used) | 2.75 | 2.75 | 2.50 | 2.75 | 2.75 | 2.75 |
| AVERAGE | 3.70 | 4.14 | 3.93 | 3.64 | 3.75 | 3.68 |

As can be seen from TABLE XV, stain removal efficiency decreased as the carbon length of the 1-alkene present in the maleic anhydride copolymer increased. Generally, lower amounts of excess maleic anhydride gave better stain removal efficiency as the carbon length of the alpha olefin was decreased. The polymers containing 1-octadecene were the poorest of the group tested for stain removal from 100% cotton and similar to Examples 42 and 45 on the BLEND fabric.

The particulate soil removal and anti-redeposition characteristics of Examples 42–47 were also evaluated as was done in the previous Examples including such testing using two washing cycles. The results obtained are reported in TABLE XVI below.

TABLE XVI

| | Example | | | | | |
|---|---|---|---|---|---|---|
| | 42 | 43 | 44 | 45 | 46 | 47 |
| CLAY BLEND | 21.4 | 20.0 | 18.8 | 19.2 | 20.5 | 21.1 |
| WFK/COT | 21.5 | 22.1 | 19.9 | 20.2 | 19.1 | 20.0 |
| WFK/BLEND | 14.2 | 16.4 | 15.8 | 17.1 | 16.0 | 15.4 |
| WFK/POLY | 17.0 | 17.3 | 14.1 | 14.9 | 14.2 | 13.7 |
| COTTON | 21.1 | 25.6 | 25.0 | 22.9 | 24.3 | 20.6 |
| BLEND | 9.6 | 10.2 | 9.5 | 9.8 | 8.9 | 10.0 |
| POLY | 17.9 | 18.9 | 18.3 | 17.4 | 16.7 | 17.9 |
| EDGE/COT | 10.8 | 13.1 | 12.7 | 11.4 | 13.2 | 12.2 |
| EDGE/BLEND | 5.7 | 5.4 | 5.3 | 5.5 | 4.2 | 5.7 |
| EDGE/POLY | 2.4 | 2.4 | 2.4 | 2.1 | 2.1 | 2.0 |

As can be seen from TABLE XVI, Examples 42–47 were fairly comparable to each other in particulate soil removal and in anti-redeposition characteristics for the fabrics and materials tested.

EXAMPLES 48–50

These Examples describe the attempt to reproduce Example 5 of the Smith et al. European Patent Application No. EP 0 000 224. Example 48 was to reproduce Example 5. Examples 49 and 50 were intended to follow the instructions found on page 30 of the '224 Patent Application to substitute a 1-hexene-maleic acid copolymer for the GANTREZ® AN119.

The maleic anhydride polymers used were GANTREZ AN119 from GAF Corporation having a measured molecular weight of $M_w$ 24,775 and $M_n$ 2,413, an MAH/$C_6$ polymer of maleic anhydride and 1-hexene having a molecular weight of $M_w$ 8,190 and $M_n$ 3,450 (hereinafter "MAH/$C_6$-1"), and an MAH/$C_6$ polymer of maleic anhydride and 1-hexene having a molecular weight of $M_w$ 2,382 and $M_n$ 1,075 (hereinafter "MAH/$C_6$-2"). The molecular weights were determined using gel permeation chromatography, polystyrene standards. On page 26, the '224 Patent states that the GANTREZ AN119 polymer has a molecular weight of 240,000, but our analysis gave a molecular weight of one-tenth of that number. The '224 Patent calls for the use of a 1-hexene-maleic acid copolymer of 25,000 or 30,000 molecular weight and in view of the differences noted with respect to the GANTREZ AN119 molecular weight, it was felt that the polymers used in this experiment were comparable to what was called for by the '224 Patent.

The 15% resin cuts used had the following formulation: 15 parts of the polymer, 7.5 parts of 50% aqueous sodium hydroxide solution and 77.5 parts of tap water.

The base formulation used for Examples 48–50 was: 13.33% of linear sodium alkylate sulfonate (60% actives) from Stepan Company, 6.00% of lauryl trimethyl ammonium chloride (50% actives) from Sherex Chemical Company, 4.00% DOBANOL 45-7 which was a $C_{14}$–$C_{15}$ linear primary alcohol ethoxylate having an average of 7 moles of ethylene oxide per molecule from Shell Chemicals, UK, 4.00% DOBANOL 45-4 which was a $C_{14}$–$C_{15}$ linear primary alcohol ethoxylate having an average of 4 moles of ethylene oxide per molecule from Shell Chemicals, UK, 18.00% disodium pyrophosphate, 6.67% of one of the 15% polymer resin cuts (Example 48 used the 15% GANTREZ AN119 resin cut; Example 49 used the 15% MAH/$C_6$-1 resin cut; and Example 50 used the 15% MAH/$C_6$-2 resin cut), 1.00% of DEQUEST® 2060 which was diethylene triamine penta(methylene phosphonic acid) from Monsanto Company, 10.00% sodium benzoate from Monsanto Company, 2.00% SAG® Silicone Antifoam 10 from Union Carbide Corporation, 0.30% microcrystalline wax sold by Witco-Netherlands under the name WITCODOR™ 272 having a melting point of 35°–115° C., 0.15% of a brightener sold by Ciba-Geigy Corporation under the name TINOPAL CBS-X which is a distyrylbiphenyl derivative, and 34.55% tap water.

Examples 48–50 had pH values of 6.0, 6.2 and 6.0 after preparation. All three compositions had an opaque appearance and separated into layers upon standing and were thus not stable, single phase compositions. Thus, the '224 Patent does not suggest the method of the present invention since the compositions obtained were not clear or single phase compositions.

EXAMPLES 51–53

In these Examples, Example 25 of British Patent No. 1,596,756 containing GANTREZ AN139 was repeated as Example 51 and Examples 52–53 show the effect of substituting a 1-hexene-maleic anhydride copolymer for the GANTREZ AN139.

The maleic anhydride polymers used were GANTREZ AN139 from GAF Corporation (molecular weight was not measured), the MAH/$C_6$-1 used in Example 49, and an MAH/$C_6$ polymer of maleic anhydride and 1-hexene having a molecular weight of $M_w$ 9,289 and $M_n$ 3,460 (hereinafter "MAH/$C_6$-3"). The molecular weights were determined using gel permeation chromatography, polystyrene standards.

The GANTREZ AN139 was not used as a resin cut since the '756 Patent did not call for such use. The 15% MAH/$C_6$ resin cuts used had the following formulation: 15 parts of the MAH/$C_6$ polymer, 7.5 parts of 50% aqueous sodium hydroxide solution and 77.5 parts of tap water. Since the final pH of the Example 51 composition was 8.0, the GANTREZ AN139 was assumed to have been hydrolyzed.

The composition of Example 51 was as follows: 33.33% of triethanolammonium dodecyl benzene sulfonate (60% actives) from Continental Chemical, 20.00% DOBANOL 45-7, 14.00% tetrapotassium pyrophosphate, 5.00% sodium silicate, 1.00% GANTREZ AN139, 1.00% DEQUEST 2041 from Monsanto Company which was ethylene diamine tetra(methylene phosphonic acid) at 90% actives in the form of a white, wet cake material (used, at the recommendation of Monsanto Company, in place of DEQUEST 2040 which was no longer manufactured or available), 15.00% of sodium toluene sulfonate (40% actives) from Texaco Chemical Company, 10.00% SDA-3A denatured 95% ethyl alcohol from U.S. Industrial, and 0.67% tap water.

The composition of Examples 52–53 was as follows: 33.33% of triethanolammonium dodecyl benzene sulfonate (60% actives) from Continental Chemical, 20.00% DOBANOL 45-7, 14.00% tetrapotassium pyrophosphate, 5.00% sodium silicate, 6.67% of the 15% polymer cut (Example 52 used MAH/$C_6$-1 and Example 53 used MAH/$C_6$-3), 1.00% DEQUEST 2041, 6.45% of sodium toluene sulfonate (93% actives) from Texaco Chemical Company, 10.00% SDA-3A denatured 95% ethyl alcohol from U.S. Industrial, and 3.55% tap water.

Examples 51–53 had pH values of 8.0, 8.7 and 8.7 after preparation. All three compositions had an opaque appearance and separated into layers upon standing and were thus not stable, single phase compositions. Thus, the '756 Patent does not suggest the method of the present invention since the compositions obtained were not clear or single phase compositions.

EXAMPLES 54–58

These Examples demonstrate the lack of hydrotrope properties possessed by GANTREZ AN119 in comparison with an MAH/$C_{10}$ copolymer useful as a hydrotrope in the method of the present invention.

The GANTREZ AN119 was used as a 10% resin cut having the following formulation: 10 parts of the GANTREZ AN119, 2 molar equivalents of 50% aqueous sodium hydroxide solution and the balance was tap water. The MAH/$C_{10}$ resin was used as a 20% resin cut used having the following formulation: 20 parts of the MAH/$C_{10}$ polymer, 10.2 parts of concentrated aqueous ammonium hydroxide solution and 69.8 parts of tap water.

The formulation of comparative Example 54 was 38.4% tap water, 5.0% borax, 40.0% GANTREZ AN119 10% resin cut, 15.0% SURFONIC N-95, and 1.6% aqueous 50% sodium hydroxide solution. The resulting composition had a pH of 7.5, was clear and single phase, but very viscous.

Since Example 54 appeared to indicate that the GANTREZ AN119 was acting as a hydrotrope, comparative Example 55 was prepared which did not contain any GANTREZ AN119 to see if the detergent composition would become cloudy or two phase. Example 55 had the following formulation: 78.4% tap water, 5.0% borax, 15.0% SURFONIC N-95, and 1.6% aqueous 50% sodium hydroxide solution. The resulting composition had a pH of 9.8, was clear and single phase, but viscous. Thus this detergent composition did not appear to require a hydrotrope to become clear and single phase.

Since Example 55 was much more alkaline than Example 54, comparative Example 56 was made which used the same composition as Example 55, but contained 1.5% citric acid and correspondingly less tap water (76.9%) to reduce the pH of the composition. Example 56 had a pH of 7.5 and was clear, single phase and viscous. Thus the amount of ionic borax builder was not enough to cause instability and phase separation in this detergent composition.

To test the hydrotrope properties of GANTREZ AN119, comparative Example 57 was prepared which was similar to Example 54, but further contained 5.0% of another builder, nitrilotriacetic acid. Thus the formulation of Example 57 was: 31.69% tap water, 5.0% borax, 1.00% citric acid, 40.0% GANTREZ AN119 10% resin cut, 15.0% SURFONIC N-95, 5.00% nitrilotriacetic acid and 2.31% aqueous 50% sodium hydroxide solution. The resulting composition had a pH of 7.5, was cloudy and separated into two phases upon standing. Apparently the increased level of builder caused the formerly clear and stable composition to become cloudy and unstable. The GANTREZ AN119 did not help to retain that clarity and stability.

In Example 58, the MAH/$C_{10}$ copolymer was substituted for the same amount of GANTREZ AN119 in the formulation of Example 57. More citric acid was needed in Example 58 than in Example 57 to obtain a pH of 7.5. Thus, the formulation of Example 58 was: 52.5% tap water, 5.0% borax, 2.2% citric acid, 20.0% MAH/$C_{10}$ 20% resin cut, 15.0% SURFONIC N-95, 5.00% nitrilotriacetic acid and sufficient aqueous 50% sodium hydroxide solution to obtain a pH of 7.5. The resulting composition had a pH of 7.5, was clear and remained single phase upon standing. Thus, the MAH/$C_{10}$ copolymer functioned as a hydrotrope while the GANTREZ AN119 did not.

What we claim is:

1. A method of stabilizing and forming a clear, stable, single phase built solvated aqueous detergent composition consisting essentially of:

(a) at least one nonionic surfactant in an amount of from about 5 to 25% by weight of the composition;

(b) a builder selected from the group consisting of nonphosphorus inorganic builders, phosphates, nonphosphorus organic builders and mixture thereof, said builder being present in an amount of from about 2 to 25% by weight of the composition; and (c) the balance consisting essentially of water; said method consisting essentially of adding to said aqueous composition an amount of a water-soluble polymeric anionic hydrotrope effective to render the aqueous detergent composition clear, stable and single phase, about 1 to 10% by weight of the composition being said hydrotrope, said hydrotrope being a hydrolyzed polymer selected from the group consisting of a copolymer of maleic anhydride monomer and an alpha olefin monomer having from 6 to about 24 carbon atoms and a ter- or higher polymer of maleic anhydride and alpha olefins selected from the group consisting of alpha olefins having a carbon content of $C_2$ to $C_{30+}$ and said ter- or higher polymer contains at least two different alpha olefins, at least one of said alpha olefins being a $C_2$ to $C_{18}$ alpha olefin and the ratio of alpha olefins present in such that the average alpha olefin carbon chain length in said ter- or higher polymer is greater than about 6 and less than about 18, and wherein the aqueous solvated detergent composition has a pH in the range of from about 6 to 9.

2. The method of claim 1, wherein said nonionic surfactants are selected from the group consisting of polyethylene condensates of alkylphenols having an alkyl group containing from about 6 to 12 carbon atoms with ethylene oxide, said ethylene oxide being present in an amount of about 5 to 25 moles of ethylene oxide per mole of alkylphenol, condensation products of ethylene oxide with a hydrophobic base formed by the condensation of propylene oxide with propylene glycol, said hydrophobic base having a molecular weight of from about 1500 to 1800, condensation products of ethylene oxide with the reaction product of propylene oxide and ethylene diamine, semi-polar nonionic water soluble amine oxide surfactants having the formula

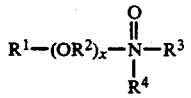

wherein $R^1$ is an alkyl, hydroxyl or alkylphenol group having a carbon content of about $C_8$ to $C_{22}$, $R^2$ is an alkylene or hydroxyalkylene group having a carbon content of about $C_2$ to $C_3$, x is a number from 0 to about 3, and each $R^3$ and $R^4$ is an alkyl or hydroxyalkyl group having a carbon content of about $C_1$ to $C_3$ or a polyethylene oxide group containing from about 1 to 3 ethylene oxide groups, alkyl polysaccharides having the formula $$R^5—O(C_wH_{2w}O)_z(\text{Glycosyl})_q$$

wherein $R^5$ is an alkyl, alkylphenol, hydroxyalkyl or hydroxyalkylphenol group, said alkyl-containing groups having a carbon content of about $C_{10}$ to $C_{18}$, w is a number of from about 2 to 3, z is a number of from about 0 to 10, and q is a number of from about 1 to 3; and fatty acid amides having the formula

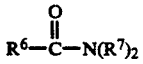

wherein $R^6$ is an alkyl group having carbon content of about $C_7$ to $C_{21}$, and $R^7$ is hydrogen, a $C_1$ to $C_4$ alkyl group, a $C_1$ to $C_4$ hydroxyalkyl group or $—(C_2H_4O)_pH$ where p varies from about 1 to 3, and mixtures thereof.

3. The method of claim 1, wherein the average carbon content of the total amount of alpha olefin present in said hydrolyzed polymer is from $C_6$ to no more than about $C_{10}$.

4. The method of claim 1, wherein said nonphosphorous inorganic builders are borates selected from the group consisting of sodium tetraborate, disodium octoborate tetrahydrate, sodium metaborate and mixtures thereof.

5. The method of claim 1, wherein said phosphates are selected from the group consisting of sodium tripolyphosphate, tetrapyropolyphosphate, tetrasodium pyrophosphate, disodium pyrophosphate, sodium metaphosphate, sodium hexametaphosphate, the analogous potassium salts, and mixtures thereof.

6. The method of claim 1, wherein said nonphosphorus inorganic builders are selected from the group consisting of sodium carbonate, potassium carbonate, sodium bicarbonate, sodium sesquicarbonate and mixtures thereof.

7. The method of claim 1, wherein said nonphosphorus organic builders are selected from the group consisting of alkali metal, ammonium and $C_1$ to $C_4$ alkylammonium salts of polyacetates, carboxylates, polycarboxylates, polyhydroxysulfonates, and mixtures thereof.

8. The method of claim 1, further including at least one additional builder in an amount of from about 2 to 10% by weight of the composition.

9. The method of claim 8, wherein said additional builder is selected from the group consisting of salts of hexamethylenediamine tetraacetic acid, salts of diethylenetriamine pentaacetic acid, alkali silicates, and mixtures thereof.

10. The method of claim 1, further including at least one cationic quaternary ammonium fabric softener selected from the group consisting of:

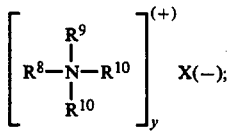

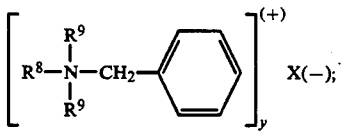

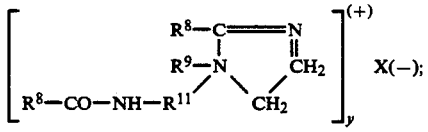

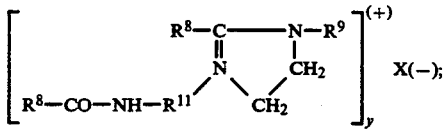

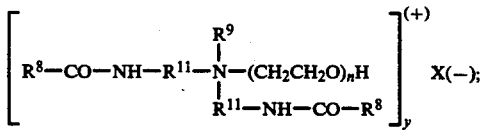

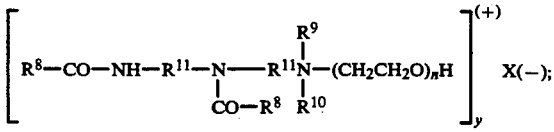

-continued

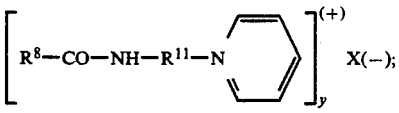

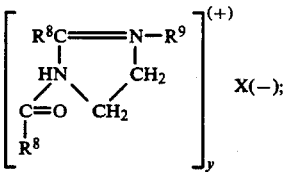

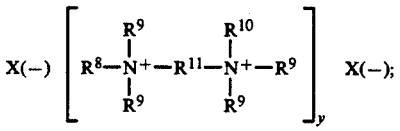

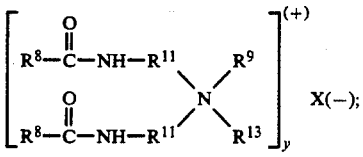

the reaction product of about 2 moles of an acid having a formula $R^{12}COOH$ and about 1 mole of an alkylene diamine having a formula $H_2N—C_2H_4—NHR^{13}$ where said reaction product is a mixture of amides, esters and imidazolines; and mixtures thereof, wherein $R^8$ is an alkyl or alkenyl straight or branched chain hydrocarbon containing from 8 to 22 carbon atoms, $R^9$ is an alkyl group containing from 1 to 3 carbon atoms, $R^{10}$ is $R^8$ or $R^9$, $R^{11}$ is a divalent alkylene group containing from 1 to 2 carbon atoms, $R^{12}$ is an alkyl group containing from 15 to 19 carbon atoms, $R^{13}$ is a hydroxyalkyl group containing from 1 to 3 carbon atoms, X is a water soluble anion, y is the valence of X and n represents an integer from 1 to 4.

11. The method of claim 10, wherein said quaternary ammonium fabric softener is selected from the group consisting of ditallow dimethyl ammonium chloride, methyl-1-tallow amido ethyl-2-tallow imadazilonium methylsulfate, methyl-bis(tallow amido ethyl)2-hydroxyethyl ammonium methyl sulfate, methyl-bis-2-hydroxyethyl coco ammonium methyl sulfate, and mixtures thereof.

12. The method of claim 1, further including from about 2 to 25% by weight of the composition of at least one anionic surfactant selected from the group consisting of alkali metal, ammonium and $C_1$ to $C_4$ alkylammonium salts of fatty acids having a carbon content of from about $C_{10}$ to $C_{20}$, water soluble alkali metal, ammonium or $C_1$ to $C_4$ alkylammonium salts of organic sulfuric reaction products having an alkyl group containing about $C_{10}$ to $C_{20}$ carbon content and a sulfonic acid or sulfuric acid ester group, water soluble salts of esters of alpha-sulfonated fatty acids having a carbon content of about $C_6$ to $C_{20}$ in the fatty acid group and from about $C_1$ to $C_{10}$ carbon content in the ester group, water soluble salts of 2-acyloxy-alkane-1-sulfonic acids containing from about $C_2$ to $C_9$ carbon content in the alkyl group and about $C_9$ to $C_{23}$ carbon content in the alkane moiety, alkyl ether sulfates containing from about $C_{10}$ to $C_{20}$ carbon content in the alkyl group and from 1 to 30 moles of ethylene oxide, water soluble salts of olefin sulfonates containing from about $C_{12}$ to $C_{24}$ carbon content, beta-alkyloxyalkane sulfonates containing from about $C_1$ to $C_3$ carbon content in the alkyl group and from about $C_8$ to $C_{20}$ carbon content in the alkane moiety, anionic phosphate surfactants, N-alkyl substituted succinamates, and mixtures thereof.

13. The method of claim 1, further including from about 0.01 to 5% by weight of the composition of proteolytic enzymes.

14. The method of claim 1, further including an optical brightener present in an amount from about 0.05 to 5% by weight of the composition.

15. The method of claim 1, wherein said pH is 7 to 8.5.

16. The method of claim 1, wherein said hydrotrope is a hydrolyzed alpha olefin maleic anhydride copolymer having a carbon content of about $C_6$ to $C_{10}$.

17. The method of claim 1, wherein said hydrotrope is a hydrolyzed terpolymer of maleic anhydride, a $C_6$ alpha olefin and a $C_{10}$ alpha olefin.

18. The method of claim 1, further including an acid pH adjuster, said pH adjuster being present in an amount of about 0.1 to 5% by weight of the composition.

19. The method of claim 18, wherein said pH adjuster is selected from the group consisting of boric acid, citric acid, succinic acid, maleic acid, and mixtures thereof.

20. A method of stabilizing and forming a clear, stable solvated single phase built liquid detergent composition consisting essentially of:

(a) at least one nonionic surfactant in an amount of from about 5 to 25% by weight of the composition, said nonionic surfactant selected from the group consisting of nonylphenol ethyoxylated with about 12 to 4 moles of ethylene oxide, $C_9$ to $C_{15}$ linear primary alcohol ethoxylates, $C_8$ to $C_{20}$ secondary alcohol ethoxylates, and mixtures thereof;

(b) at least one builder in an amount of about 2 to 25% by weight of the composition selected from the group consisting of salts of nitrilotriacetic acid, sodium tetraborate, disodium octoborate tetrahydrate, sodium metaborate, phosphates, and mixtures thereof;

(c) an additional builder system in an amount of about 2 to 10% by weight of the composition, said system selected from the group consisting of alkali silicates, nonphosphorus inorganic builders, nonphosphorus organic builders and mixtures thereof;

(d) an acid pH adjuster present in an amount of from about 0.1 to 5% by weight of the composition;

(e) effective amounts of proteolytic enzymes;

(f) at least one cationic quaternary ammonium fabric softener selected from the group consisting of ditallow dimethyl ammonium chloride, methyl-1-tallow amido ethyl-2-tallow imadazilonium methyl sulfate, methyl-bis(tallow amido ethyl)2-hydroxyethyl ammonium methyl sulfate, methyl-bis-2-hydroxyethyl coco ammonium methyl sulfate and mixtures thereof;

(g) from about 2 to 25% by weight of the composition of at least one anionic surfactant selected from the group consisting of alkali metal, ammonium and $C_1$ to $C_4$ alkylammonium salts of fatty acids having a carbon content of about $C_{10}$ to $C_{20}$, water soluble alkali metal, ammonium or $C_1$ to $C_4$ alkylammonium salts of organic sulfuric reaction products having an alkyl group containing about $C_{10}$ to $C_{20}$ carbon content and a sulfonic acid or sulfuric acid ester group, water soluble salts of esters of alpha-sulfonated fatty acids having a carbon content of about $C_6$ to $C_{20}$ in the fatty acid group and from about $C_1$ to $C_{10}$ carbon content in the ester group, water soluble salts of 2-acyloxy-alkane-1-sulfonic acids containing from about $C_2$ to $C_9$ carbon content in the alkyl group and about $C_9$ to $C_{23}$ carbon content in the alkane moiety, alkyl ether sulfates containing from about $C_{10}$ to $C_{20}$ carbon content in the alkyl group and from 1 to 30 moles of ethylene oxide, water soluble salts of olefin sulfonates containing from about $C_{12}$ to $C_{24}$ carbon content, beta-alkyloxy alkane sulfonates containing from about $C_1$ to $C_3$ carbon content in the alkyl group and from about $C_8$ to $C_{20}$ carbon content in the alkane moiety, anionic phosphate surfactants, N-alkyl substituted succinamates, and mixtures thereof; and (h) the balance consisting essentially of water, said method consisting essentially of the step of adding to said aqueous composition an amount of a water soluble polymeric anionic hydrotrope effective to render the aqueous detergent composition clear, stable and one phase, about 1 to 10% by weight of the composition being said hydrotrope, said hydrotrope being selected from substantially non-cross-linked hydrolyzed alpha olefin maleic anhydride polymers selected from the group consisting of a copolymer of maleic anhydride monomer and an alpha olefin monomer having from 6 to about 24 carbon atoms and a ter- or higher polymer of maleic anhydride and alpha olefins selected from the group consisting of alpha olefins having a carbon content of $C_2$ to $C_{30+}$ and said ter- or higher polymer contains at least two different alpha olefins, at least one of said alpha olefins being a $C_2$ to $C_{18}$ alpha olefin and the ratio of alpha olefins present in such that the average alpha olefin carbon chain length in said ter- or higher polymer is greater than about 6 and less than about 18 and wherein said composition has a pH in the range of about 7 to 8.5.

21. A method of stabilizing and forming a clear, stable, single phase built solvated aqueous detergent composition consisting essentially of:

(a) at least one nonionic surfactant in an amount of from about 5 to 25% by weight of the composition;

(b) a builder selected from the group consisting of nonphosphorus inorganic builders, phosphates, nonphosphorus organic builders, and mixtures thereof, said builder being present in an amount of from about 2 to 25% by weight of the composition; and (c) at least one cationic quaternary ammonium fabric softener selected from the group consisting of:

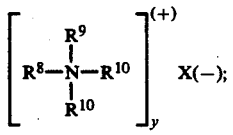

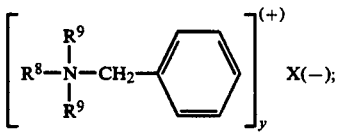

-continued

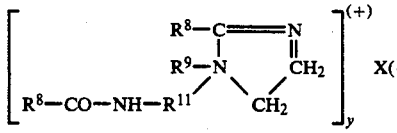

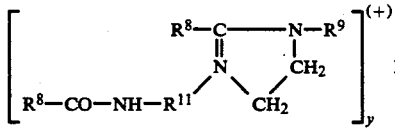

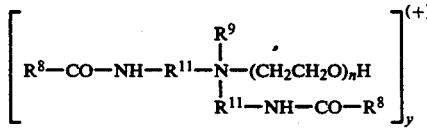

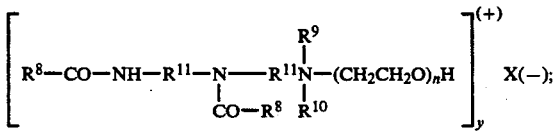

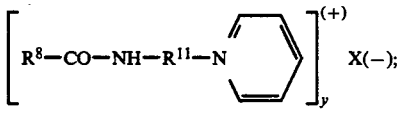

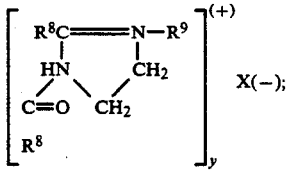

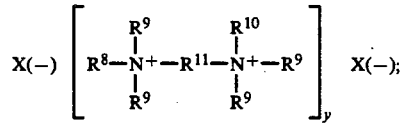

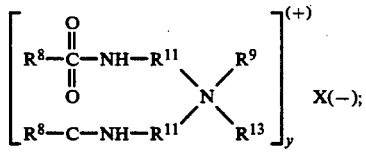

the reaction product of about 2 moles of an acid having a formula $R^{12}COOH$ and about 1 mole of an alkylene diamine having a formula $H_2N—C_2H_4—NHR^{13}$ where said reaction product is a mixture of amides, esters and imidazolines; and mixtures thereof, wherein $R^8$ is an alkyl or alkenyl straight or branched chain hydrocarbon containing from 8 to 22 carbon atoms, $R^9$ is an alkyl group containing from 1 to 3 carbon atoms, $R^{10}$ is $R^8$ or $R^9$, $R^{11}$ is a divalent alkylene group containing from 1 to 2 carbon atoms, $R^{12}$ is an alkyl group containing from 15 to 19 carbon atoms, $R^{13}$ is a hydroxyalkyl group containing from 1 to 3 carbon atoms, X is a water soluble anion, y is the valence of X and n represents an integer from 1 to 4; and (d) the balance consisting essentially of water;

said method consisting essentially of the step of adding to said aqueous composition an amount of a water soluble polymeric anionic hydrotrope effective to render the aqueous detergent composition clear, stable and one phase, about 1 to 10% by weight of the composition being said hydrotrope, said hydrotrope being a substantially non-cross-linked hydrolyzed polymer selected from the group consisting of a copolymer of maleic anhydride monomer and an alpha olefin monomer having from 6 to about 24 carbon atoms and a ter- or higher polymer of maleic anhydride and alpha olefins selected from the group consisting of alpha olefins having a carbon content of $C_2$ to $C_{30+}$ and said ter- or higher polymer contains at least two different alpha olefins, at least one of said alpha olefins being a $C_2$ to $C_{18}$ alpha olefin and the ratio of alpha olefins present is such that the average alpha olefin carbon chain length in said ter- or higher polymer is greater than about 6 and less than about 18 and wherein the aqueous solvated detergent composition has a pH in the range of from about 6 to 9.

* * * * *

UNITED STATES PATENT AND TRADEMARK OFFICE

CERTIFICATE OF CORRECTION

PATENT NO. : 5,205,960

DATED : April 27, 1993

INVENTOR(S) : Karen K. Kristopeit and Calvin J. Verbrugge

It is certified that error appears in the above-identified patent and that said Letters Patent is hereby corrected as shown below:

In column 13, lines 15-20, please substitute with the following:

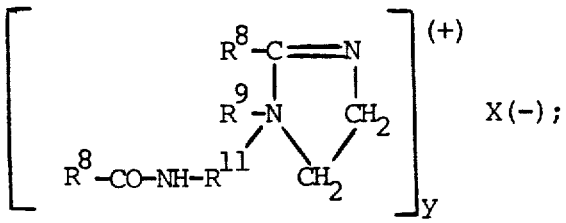

X(-);

In column 38, lines 45-50, please substitute with the following:

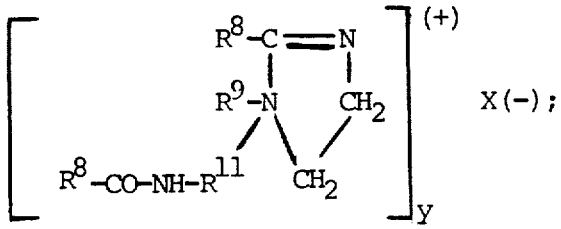

X(-);

UNITED STATES PATENT AND TRADEMARK OFFICE

CERTIFICATE OF CORRECTION

PATENT NO. : 5,205,960

DATED : April 27, 1993

INVENTOR(S) : Karen K. Kristopeit and Calvin J. Verbrugge

It is certified that error appears in the above-indentified patent and that said Letters Patent is hereby corrected as shown below:

In column 42, lines 1-5, please substitute with the following:

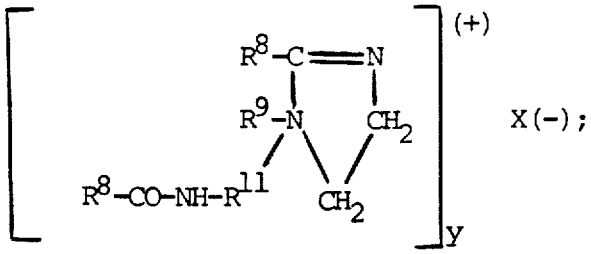

X(-);

Signed and Sealed this

Fourth Day of January, 1994

Bruce Lehman

*Attest:*

BRUCE LEHMAN

*Attesting Officer*

*Commissioner of Patents and Trademarks*